US007286782B2

(12) United States Patent
Nomura et al.

(10) Patent No.: US 7,286,782 B2
(45) Date of Patent: Oct. 23, 2007

(54) CHARGE METHOD, CHARGE APPARATUS, AND CHARGE PROGRAM FOR CHARGING USAGE FEE INCLUDING PRINT FEE AND FORMAT FEE OF AN IMAGE FORMING APPARATUS

(75) Inventors: Takuji Nomura, Yokohama (JP); Kenji Kuwana, Funabashi (JP); Yoichi Utaka, Tokyo (JP); Naoki Takashima, Yokohama (JP); Akio Watanabe, Yokohama (JP); Toshiyuki Tezuka, Tokyo (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 11/078,713

(22) Filed: Mar. 14, 2005

(65) Prior Publication Data

US 2005/0207776 A1 Sep. 22, 2005

(30) Foreign Application Priority Data

Mar. 18, 2004 (JP) ..... 2004-079151

(51) Int. Cl.
*G03G 21/00* (2006.01)

(52) U.S. Cl. ..... 399/79

(58) Field of Classification Search ..... 399/79, 399/80, 82, 8; 235/379; 705/400, 410
See application file for complete search history.

(56) References Cited

U.S. PATENT DOCUMENTS 5,045,880 A * 9/1991 Evanitsky et al. ..... 399/82
5,850,584 A * 12/1998 Robinson et al. ..... 399/79
6,282,525 B1 * 8/2001 Kubatzki et al. ..... 705/410
6,516,157 B1 * 2/2003 Maruta et al. ..... 399/8
7,147,147 B1 * 12/2006 Enright et al. ..... 235/379
2001/0028465 A1 10/2001 Sugino
2002/0041394 A1 4/2002 Chen
2002/0165833 A1 * 11/2002 Minowa et al. ..... 705/400
2003/0049037 A1 3/2003 Sadowara
2003/0107651 A1 6/2003 Chen
2004/0018027 A1 1/2004 Parker

FOREIGN PATENT DOCUMENTS

JP 05232671 A * 9/1993
JP 2000206845 A * 7/2000
JP 2000-268095 9/2000
JP 2000352910 A * 12/2000

(Continued)

OTHER PUBLICATIONS

European Search Report dated Oct. 19, 2005, directed by EP Application No. 05005863.5.

*Primary Examiner*—Quana Grainger
(74) *Attorney, Agent, or Firm*—Morrison & Foerster LLP

(57) ABSTRACT

A charge method for charging a usage fee of an image forming apparatus is disclosed. The charge method includes the steps of a) storing contents source data and contents source fee data corresponding to the contents source data, b) obtaining a first data item selected by a user, c) obtaining one item of the contents source data selected by the user, d) generating image formation information based on the first data item and the one item of the contents source data selected by the user, and e) calculating a charge fee corresponding to the image formation information in accordance with the contents source fee data.

15 Claims, 15 Drawing Sheets

FOREIGN PATENT DOCUMENTS

| | | | | |
|---|---|---|---|---|
| JP | 2002-214988 | A | | 7/2002 |
| JP | 2002/329250 | A | | 11/2002 |
| JP | 2003016523 | A | * | 1/2003 |
| JP | 2003150330 | A | * | 5/2003 |
| JP | 2003244365 | A | * | 8/2003 |
| JP | 2004240630 | A | * | 8/2004 |
| JP | 2005062755 | A | * | 3/2005 |

* cited by examiner

CHARGE METHOD, CHARGE APPARATUS, AND CHARGE PROGRAM FOR CHARGING USAGE FEE INCLUDING PRINT FEE AND FORMAT FEE OF AN IMAGE FORMING APPARATUS

BACKGROUND OF THE INVENTION

1. Field of the Invention

The present invention relates to a charge method, a charge apparatus, and a charge program for an image forming apparatus.

2. Description of the Related Art

Conventionally, in a case where an image forming apparatus is provided in a convenience store, for example, the usage fee for using the image forming apparatus is charged in accordance with, for example, the number of copies that are printed. In many cases, the usage fee is collected by employing a coin dispenser connected to the image forming apparatus. In such cases, the user deposits money beforehand into the coin dispenser and requests, for example, copying of a document. On the other hand, each time the image forming apparatus executes a copying operation, for example, the image forming apparatus withdraws a prescribed amount and calculates the amount of money remaining in the coin dispenser.

As a method of charging a usage fee in a case of using an image forming apparatus provided in a convenience store, for example, Japanese Laid-Open Patent Application No. 2000-268095 discloses of calculating method which obtains a total fee of adding data contents fee or communication fee to a printing fee. This method is employed in a case where the image that is to be printed is obtained from a Web site, wherein the method calculates the total fee of adding together the data contents fee of the image to the print fee and the communication fee, and provides the data contents (image) when the calculated total fee is deposited.

However, in a case of printing, for example, a photograph (s) (image) taken by a digital camera, the user may desire to print multiple photographs on a single sheet of paper. In another case, if the user were able to bring in an image of his/her own and apply the image to a format provided by an image forming apparatus at a convenience store or the like, the image forming apparatus can be used for wider purposes. In such cases where various services are provided by allowing the user to use contents provided by an image forming apparatus of a convenience store or the like, it is desired to charge the user with an appropriate fee corresponding to the service or contents that is used.

SUMMARY OF THE INVENTION

It is a general object of the present invention to provide a charge method, a charge apparatus, and a charge program for an image forming apparatus that substantially obviates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a charge method, a charge apparatus, and a charge program for an image forming apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a charge method for charging a usage fee of an image forming apparatus, the charge method including the steps of: a) storing contents source data and contents source fee data corresponding to the contents source data; b) obtaining a first data item selected by a user; c) obtaining one item of the contents source data selected by the user; d) generating image formation information based on the first data item and the one item of the contents source data selected by the user; and e) calculating a charge fee corresponding to the image formation information in accordance with the contents source fee data.

In the charge method according to an embodiment of the present invention, the contents source data fee may include data of an image formation fee and data of a contents source data usage fee; wherein the step e) includes the steps of calculating a first charge fee based on the contents source data usage fee, calculating a second charge fee based on the image formation fee, and calculating a sum of the first charge fee and the second charge fee.

Furthermore, the present invention provides a charge apparatus for charging a usage fee of an image forming apparatus, the charge apparatus including: a storing part for storing contents source data and contents source fee data corresponding to the contents source data; a first obtaining part for obtaining a first data item selected by a user; a second obtaining part for obtaining one item of the contents source data selected by the user; a generating part for generating image formation information based on the first data item and the one item of the contents source data selected by the user; and a calculating part for calculating a charge fee corresponding to the image formation information in accordance with the contents source fee data.

In the charge method according to an embodiment of the present invention, the contents source data fee may include data of an image formation fee and data of a contents source data usage fee; wherein the calculating part further includes a first calculating part for calculating a first charge fee based on the contents source data usage fee, a second calculating part for calculating a second charge fee based on the image formation fee, and a third calculating part for calculating a sum of the first charge fee and the second charge fee.

Furthermore, the present invention provides a charge program for enabling a computer to execute a charge method, the program including the functions of: a) storing contents source data and contents source fee data corresponding to the contents source data; b) obtaining a first data item selected by a user; c) obtaining one item of the contents source data selected by the user; d) generating image formation information based on the first data item and the one item of the contents source data selected by the user; and e) calculating a charge fee corresponding to the image formation information in accordance with the contents source fee data.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to FIGS. 1-14. The embodiments of the present invention are described as a charging method, a charging apparatus, and a charging program for charging a fee according to circumstance in a case of charging the fee in using an image forming apparatus. One embodiment of the present invention provides a system including an image forming apparatus 20 and a coin dispenser 70 provided at, for example, a convenience store. Here, this embodiment of the present invention is described using a case where a printing process (printing operation) is executed with the image forming apparatus 20. It is to be noted that the image forming apparatus 20 includes, for example, a copier, a facsimile, and/or a printer.

Figure 1:
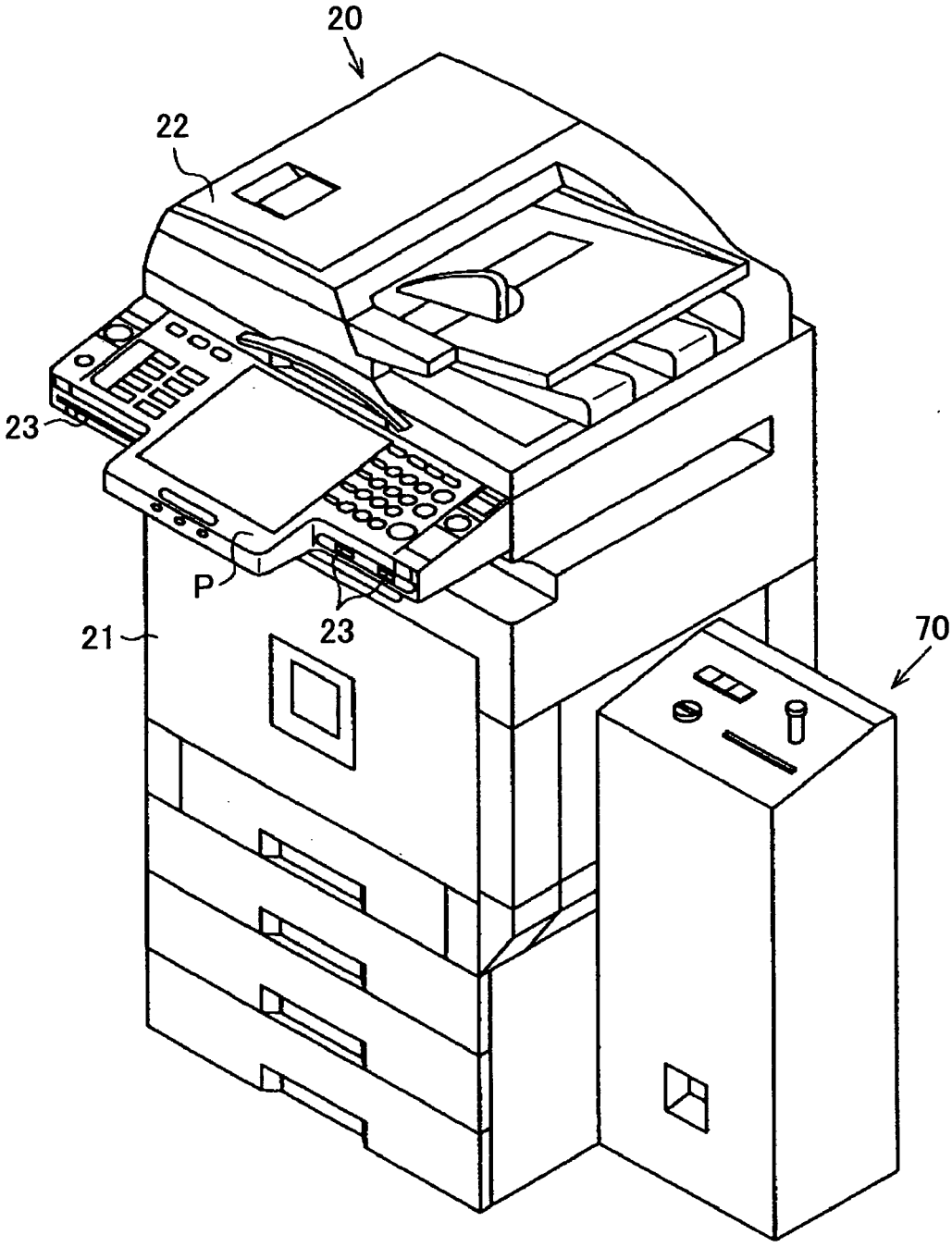
FIG. 1 is a schematic view showing a system according to an embodiment of the present invention.

As shown in FIG. 1, the image forming apparatus 20 is connected to the coin dispenser 70 (i.e. money storage part). The image forming apparatus 20 and the coin dispenser 70 form a system for charging a fee in using the image forming apparatus 20. In the collection of the fee by the coin dispenser 70, the fee is not limited to money. Alternatively, the fee may be collected by collecting, for example, electronic money from a contact or non-contact type IC card. In this case, the coin dispenser (money storage part) 70, which is provided with a function of reading the amount of money remaining in the IC card, compares a charge fee corresponding to the use of the image forming apparatus 20 of the user and the amount of money remaining in the IC card in accordance with the instructions from the image forming apparatus 20.

In the image forming apparatus 20, an image reading apparatus 22 for reading an image from an original is situated at an upper part of a printing apparatus 21 for forming an image(s) onto a sheet of paper. A control panel P for displaying information (e.g. instructions) to the user and receiving various inputs from the user is situated at an outer surface part of the image reading apparatus 22. Furthermore, an outside media input/output apparatus 23 for reading data from various media (e.g. recording medium) or writing data to a recording medium is provided at a lower part of the control panel P. An insertion part is exposed at an outer portion of the outside media input/output apparatus 23. The recording medium includes, for example, a semiconductor-memory, a flexible disk, a hard disk, and an optical disk. The outside media input/output apparatus 23 is provided with a function for reading/writing data from/to the recording media.

Figure 2:
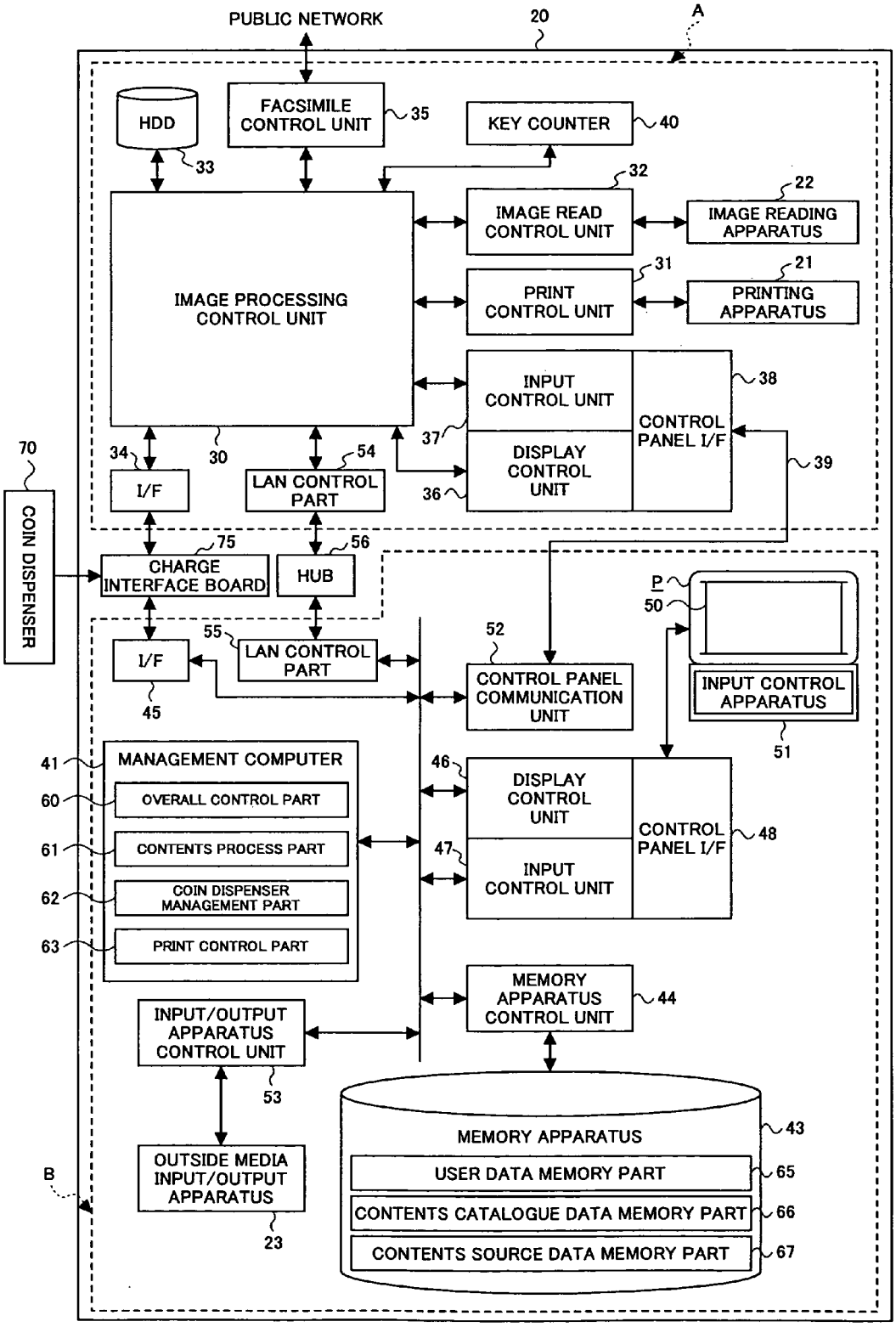
FIG. 2 is a block diagram showing an electric connection among respective parts of an image forming apparatus according to an embodiment of the present invention.

As shown in FIG. 2, the image forming apparatus 20 can be largely divided into an image processing unit part A and an information processing unit part B (i.e. information processing unit). In this embodiment of the present invention, a charge apparatus including the information processing unit is provided inside the image forming apparatus 20. The image processing unit part A includes the printing apparatus 21 and the image reading apparatus 22. The information processing unit part B includes the control panel P and the outside media input/output apparatus 23.

First, the image processing unit part A is described. The image processing unit part A includes an image processing control unit 30 for executing overall control of the image processing operation of the image processing unit part A. A print control unit 31 for controlling the printing apparatus 21 and an image read control unit 32 for controlling the image reading apparatus 22 are connected to the image processing control unit 30.

In accordance with the control of the image processing control unit 30, the printing control unit 31 outputs a printing instruction including image data to the printing apparatus 21. Accordingly, the printing apparatus 21 performs an image forming operation on a sheet of paper(s). The printing apparatus 21 can print in full color and includes various printing types such as an electrophotographic type, an inkjet type, a sublimatic thermal transfer type, a silver halide photographic type, a direct thermal recording type, and a phase change thermal transfer type.

In accordance with the control of the image processing control unit 30, the image read control unit 32 drives the image reading apparatus 22. The image reading apparatus 22 reads information by irradiating light to the surface of an original and condensing the reflected light to a light receiving element (e.g. CCD (Charge Coupled Device)) with a mirror and a lens, and executes A/D conversion, to thereby generate digital image data of 8 bit RGB data.

The image processing control unit 30 includes a microcomputer configuration having a CPU (Central Processing Unit, main processor), an SDRAM (Synchronous Dynamic Random Access Memory), a ROM (Read Only Memory), and an NVRAM connected by a bus.

Furthermore, the image processing control unit 30 is connected to a HDD (Hard Disk Drive) 33. The HDD includes data such as digital image data, job history data, etc. Furthermore, the image processing control unit 30 is connected to an charge interface board 75 in the apparatus via an I/F (interface) 34. The image processing unit part A is connected to the information processing unit part B and the coin dispenser 70 via the charge I/F board 75.

Furthermore, the image processing control unit 30 is connected to a facsimile control unit 35 for controlling a facsimile. The facsimile control unit 35 is connected to a public network. Furthermore, the image processing control unit 30 is connected to a LAN control part 54 serving as a communication interface for connecting the image processing unit part A and a LAN via a HUB 56. The image processing unit part A executes printing when the LAN control part 54 or the facsimile control unit 35 receives print data or a print command from outside.

Furthermore, the image processing control unit 30 is connected to a display control unit 36 and a input control unit 37. In accordance with the control of the image processing control unit 30, the display control unit 36 outputs an image display control signal(s) to the image processing unit part B via a communication cable 39 connected to a control panel I/F 38.

Accordingly, the display of images for the control panel P in the image processing unit part B is controlled by the image display control signal(s) output from the display control unit 36. Furthermore, the input control unit 37 inputs an input control signal(s) corresponding to an input(s) by an operation (maneuver) of the control panel P by the user via the communication cable 39 in accordance with the control of the image processing control unit 30. That is, the image processing unit part A is able to directly monitor the control panel P of the information processing unit part B via the communication cable 39.

That is, the image processing unit part A is configured to allow an image processing unit in a conventional image processing apparatus to be connected to the communication cable 39 and the control panel P of the information processing unit part B to be used. That is, the display control unit 36 and the input control unit 37 of the image processing unit part A operate in a state being connected to the control panel P.

Furthermore, the image processing control unit 30 is connected to a key counter 40. The key counter 40 counts the number of sheets processed (e.g. printed) by the image processing apparatus 20.

The charge interface board 75 is used in exchanging data between the information processing unit part B, the image processing unit part A, and the coin dispenser 70.

Next, the information processing unit part B including the charge I/F board 75 is described. The information processing unit part B includes, for example, a microcomputer configuration controlled by a versatile OS (Operating System) used by information processing apparatuses such as personal computers. The information processing unit part B includes a management computer 41. The management computer 41 includes a CPU serving as a main processor, a RAM serving as a work area of the CPU, and a ROM serving as a read only memory for storing, for example, a start-up program.

The management computer 41 is connected to a memory apparatus control unit 44. The memory apparatus control unit 44 control input/output data for a memory apparatus 43 (e.g. HDD) for storing, for example, an OS and application programs. Furthermore, the management computer 41 is connected to an I/F 45 serving as a communication interface for connecting the information processing unit part B to the image processing unit part A via the charge I/F board 75 and to the coin dispenser 70.

Furthermore, the management computer 41 is connected to a display control unit for controlling the control panel P and to an input control unit 47. The control panel P includes a display apparatus 50 (e.g. LCD (Liquid Crystal Display)) and an input control apparatus 51.

The input control apparatus 51 includes a touch panel situated on the surface of the display apparatus 50 and a key board having multiple keys. The keyboard includes, for example, a start key for starting a reading operation, a numeric pad for inputting numerals, and a stop key for stopping operation. That is, the display control unit 46 allows the display apparatus 50 to display an image(s) by outputting an image display control signal(s) to the display apparatus 50 via a control panel I/F 48. Meanwhile, the input control unit 47 receives input control signal(s) corresponding to the user's input from the control panel P via the control panel I/F 48. The image display control signal is a signal for controlling information to be displayed on the display apparatus 50. The input control signal is a signal indicative of an instruction(s) of the user obtained from, for example, the input control apparatus 51.

Furthermore, the management computer 41 is connected to a control panel communication unit 52. The control panel communication unit 52 is connected through the control panel I/F 38 and the communication cable 39. The control panel communication unit 52 receives the image display control signals from the image processing unit part A and transfers input control signals corresponding to the user's input from the control panel P to the image processing unit part A.

It is to be noted that the image display control signals received by the control panel communication unit 52 is output to the display control unit 46 after being converted to data acceptable for the display apparatus 50. The input control signals corresponding to the user's inputs from the control panel P are input to the control panel communication unit 52 after converted to data acceptable for the specification of the image processing unit part A.

Furthermore, the management computer 41 is connected to a LAN control part 55 serving as a communication interface for connecting the information processing unit part B to a LAN via a HUB 56. The LAN control part 55 is provided with an IP address which is different from that of the LAN control part 54 of the image processing unit part A. The image processing unit part A and the information processing unit part B are respectively provided with IP addresses and are respectively connected to the LAN. Accordingly, in the image forming apparatus 20, data can be exchanged between the image processing unit part A and the information processing unit part B. It is to be noted that the image forming apparatus 20 is connected to the LAN via the HUB 56. Furthermore, the image processing unit part A and the information processing unit part B are connectable to a network (e.g. Internet) via the LAN control parts 54 and 55.

As described above, the memory apparatus 43 is stored with an OS, application programs, and other various data which are executed by the CPU of the management computer 41. In the image forming apparatus 20, the CPU of the management computer 41 activates an activation program stored in the ROM when the power is switched on, reads the OS of the memory apparatus 43 into the RAM, and activates the OS. The OS executes, for example, activation of programs, reading of information, and storage of information. A versatile OS (e.g. Windows (Registered Trademark) of Microsoft is used as the OS of the information processing unit part B.

As described above, the image forming apparatus 20 includes the outside media input/output apparatus 23 for reading or writing data from/to the recording medium. The outside media input/output apparatus 23 is controlled by an input/output device control unit 53 connected to the management computer 41. Furthermore, in the information processing unit part B, the management computer 41 is connected to a voice output apparatus (not shown).

The management computer 41 includes an overall control part 60, a contents process part 61, a coin dispenser management part 62, and a print control part 63.

The overall control part 60 performs, for example, processes for obtaining and storing information required for enabling the management computer 41 to execute various processes and operations, and processes for control by coordinating functions of other parts.

The contents process part 61 includes a function of performing an image processing operation on various contents. For example, in a format printing operation, the image processing operation includes, for example, a process of inserting an image(s) into a format, or a process of previewing the contents to which an image(s) is inserted. It is to be noted that the format printing operation is not limited to applying information (e.g. images) to business formats and printing the formats, but may also include inputting and processing information to various predetermined formats and printing the formats.

The coin dispenser management part 62 executes, for example, a management operation for managing the state inside the coin dispenser 70 and an accounting operation by controlling the coin dispenser 70.

The print control part 63 executes, for example, a print instructing process for instructing the image processing unit part A to execute a printing operation.

The management computer 41 executes various processes and operation described below by using the above-described overall control part 60, the contents process part 61, the coin dispenser management part 62, and the print control part 63. Accordingly, by executing the charge problem according to an embodiment of the present invention, the management computer 41 function as a first obtaining part, a second obtaining part, a contents process part, and a calculating part stated in the claims.

Furthermore, the memory apparatus 43 includes a user data memory part 65, a content catalogue data memory part 66, and a contents source data memory part 67. The contents catalogue data memory part 66 and the contents source data memory part 67 function as a contents memory part.

The user data memory part 65 temporarily stores electronic data including, for example, image data and text data read from a recording medium of the user. It is to be noted that the electronic data stored in the user data memory part 65 is erased by overwriting random data over the electronic data in accordance with a command from the management computer 41.

With the overwriting of random data, the electronic data which may include private and confidential information of the user can be prevented from leaking to a third party. More specifically, the electronic data of the user can be erased by writing random information to a physical space in which the electronic data of the user is stored. Accordingly, the electronic data of the user cannot be read out even by using a data recovery application of the HDD.

Figure 3:
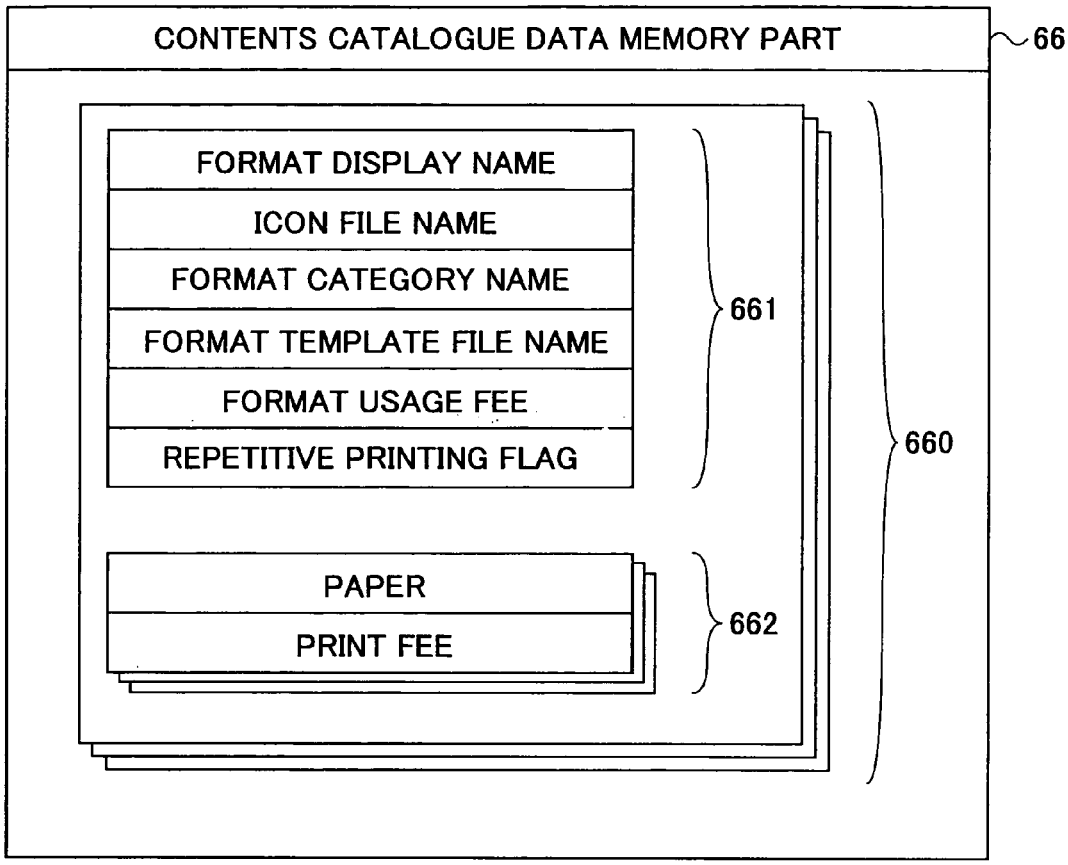
FIG. 3 is a diagram for describing data stored in a contents catalogue data memory part according to an embodiment of the present invention.

As shown in FIG. 3, the contents catalogue data memory part 66 stores contents catalogue data 660 in correspondence with each format (i.e. each contents source data). The contents catalogue data 660 is stored (recorded) when contents source data available for use by the image forming apparatus 20 is registered. The contents catalogue data 660 includes overall definition data 661 and paper definition data 662 corresponding to each type of paper.

The overall definition data 661 includes data of format display names, icon file names, format category names, format template file names, format usage fees, and repetitive printing flags.

The space including the data of the format display names is stored with, for example, data of character strings regarding a listing and names of formats of tabs which are displayed in a "format selection screen" (described below).

The space including the data of the icon file names is stored with, for example, data of file names of thumbnails of formats which are displayed in the "format selection screen".

The space including the data of the format category names is stored with, for example, data of category names and category codes for categorizing the formats. The format category names according to the embodiment of the present invention includes "photographs", "labels", "stationery" and "resumes, etc." The category code is a code used for categorizing contents source data into respective categories.

The space including the data of the format template file names is stored with, for example, data of file names of contents source data and data of for identifying the location of contents source data (e.g. path names indicating the location of contents source data).

The space including the data of the format usage fee is stored with fees that are charged for the use of the formats. For example, the format usage fee is charged only once each time a single format is used, regardless of the number of pages that are printed.

The space including the data of the repetitive printing flags is stored with, for example, flags indicating whether repetitive printing can be selected.

The paper definition data 662 includes data of paper and print fees. The space including the data of paper is stored with, for example, sizes and types of paper that are used. The space including the data of print fees is stored with, for example, a fee corresponding to the printing of a single sheet of paper (i.e. print fee/sheet).

It is to be noted that the contents catalogue data 660 according to the embodiment of the present invention is written in XML format.

The contents source data memory part 67 stores contents source data (i.e. template files of formats). The contents source data is stored with respect to the format available for use by the image forming apparatus 20. The contents source data is recorded in correspondence with the content catalogue data memory part 66.

Furthermore, the memory part includes an icon data memory part (not shown). The icon data memory part stores thumbnails of a format displayed in a "format selection screen" designated in the space of the icon file name data in the content catalogue data 660, in which the thumbnails are stored in correspondence with the format template file names.

The coin dispenser 70 is an apparatus for receiving a usage fee which is deposited when charging the user for the use of the image forming apparatus 20. The coin dispenser 70 stores money to be used as change and money that is deposited by the user, respectively.

Accordingly, the image processing unit part A performs image formation on a medium (e.g. paper) based on image formation information. The image formation information includes data that is to be printed (i.e. print data). Accordingly, a printing job includes image formation information of one or more images and a series of process instructions. Meanwhile, the information processing unit part B executes various information processes and intensively controls respective parts of the information processing unit part B and the image processing unit part A. The above-described image forming apparatus 20 which includes the image processing unit part A, the information processing unit part B, and the charge I/F board 75 and the coin dispenser 70 form a charge system.

It is to be noted that the HUB 56 is connected to an outer LAN and/or WAN and may be configured to obtain contents and image data or text data of the user from an outer network.

Figure 4:
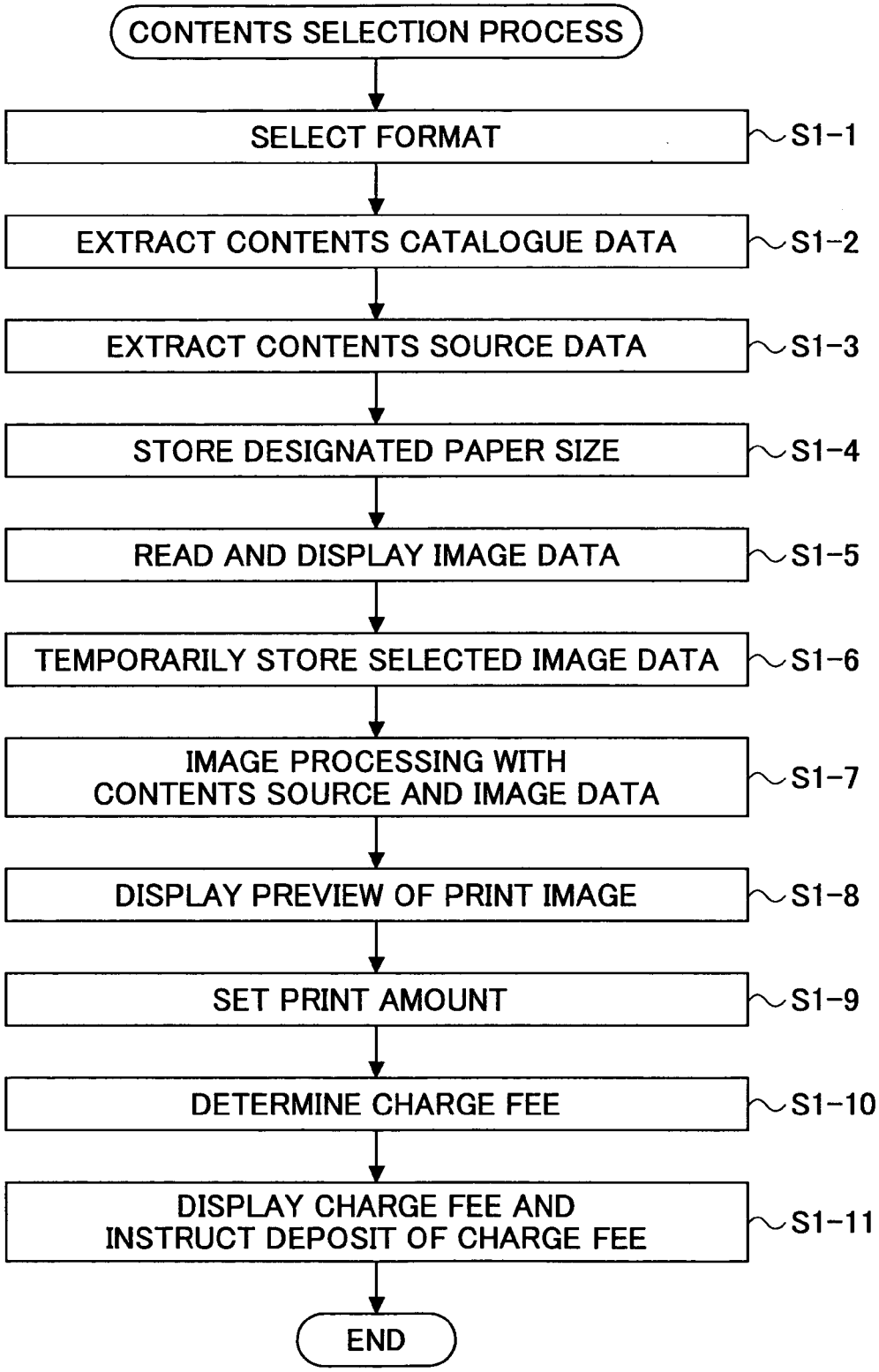
FIG. 4 is a diagram for describing a process of an operation according to an embodiment of the present invention.
Figure 5:
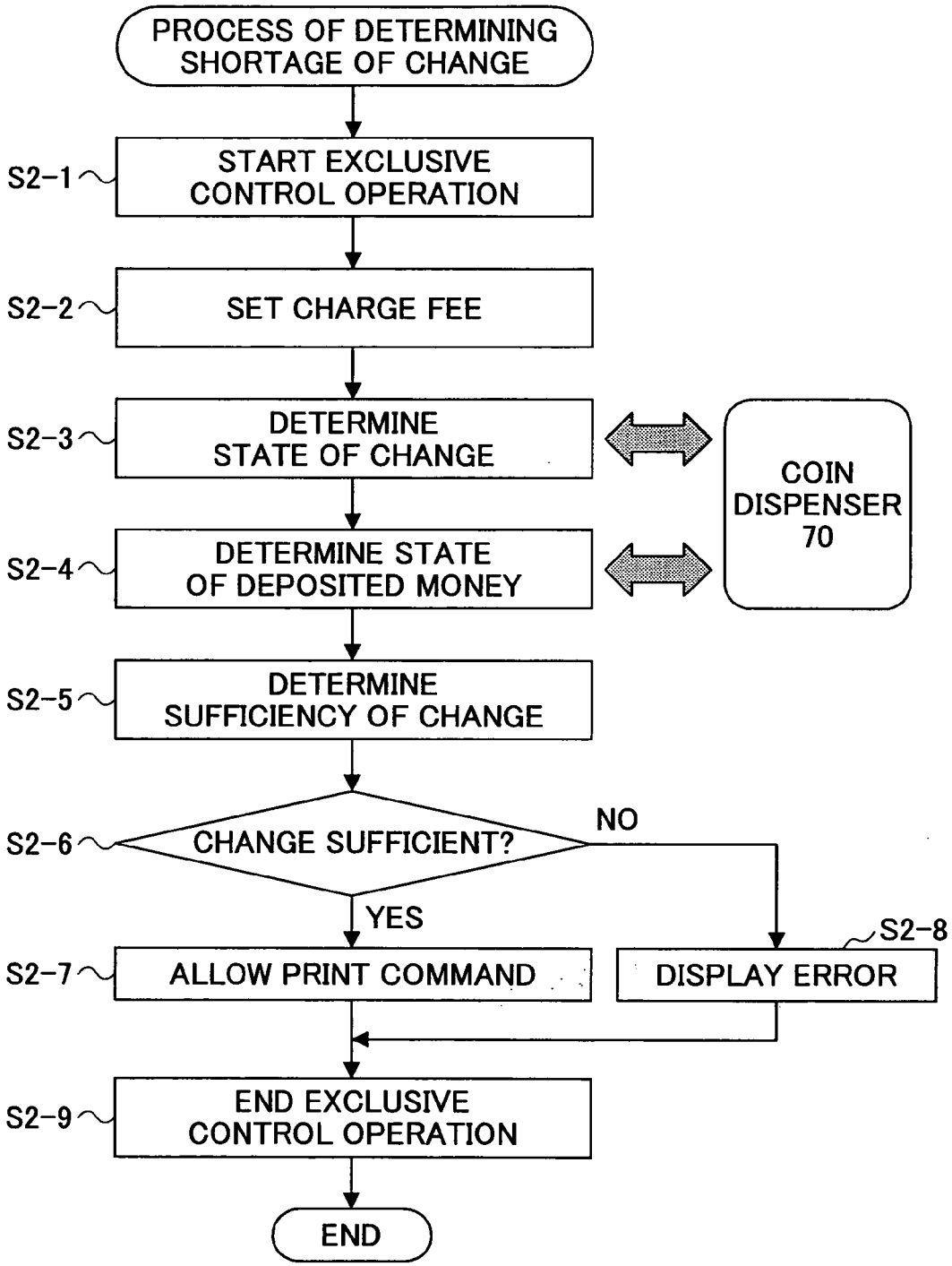
FIG. 5 is a diagram for describing a process of an operation according to an embodiment of the present invention.
Figure 6:
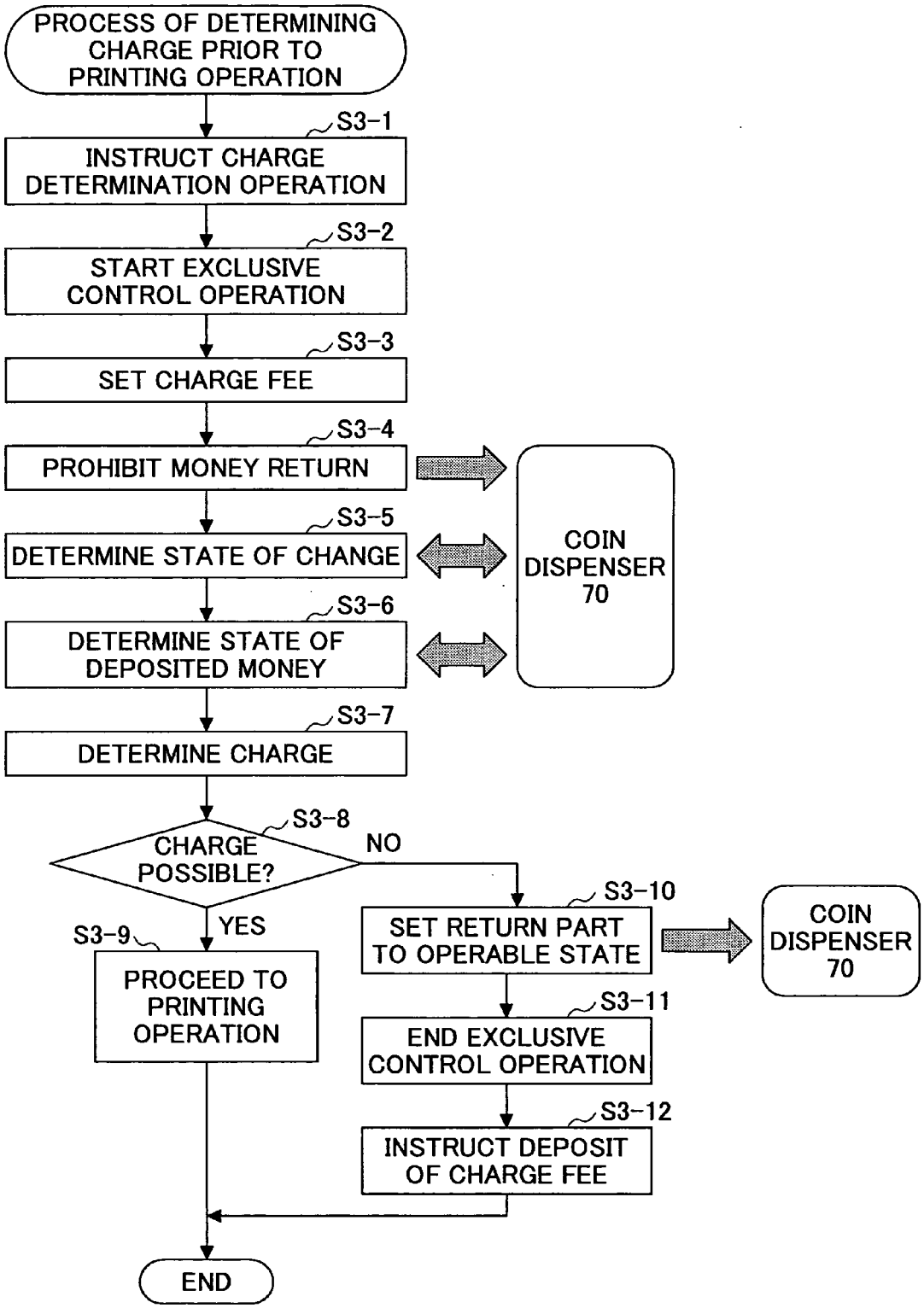
FIG. 6 is a diagram for describing a process of an operation according to an embodiment of the present invention.
Figure 7:
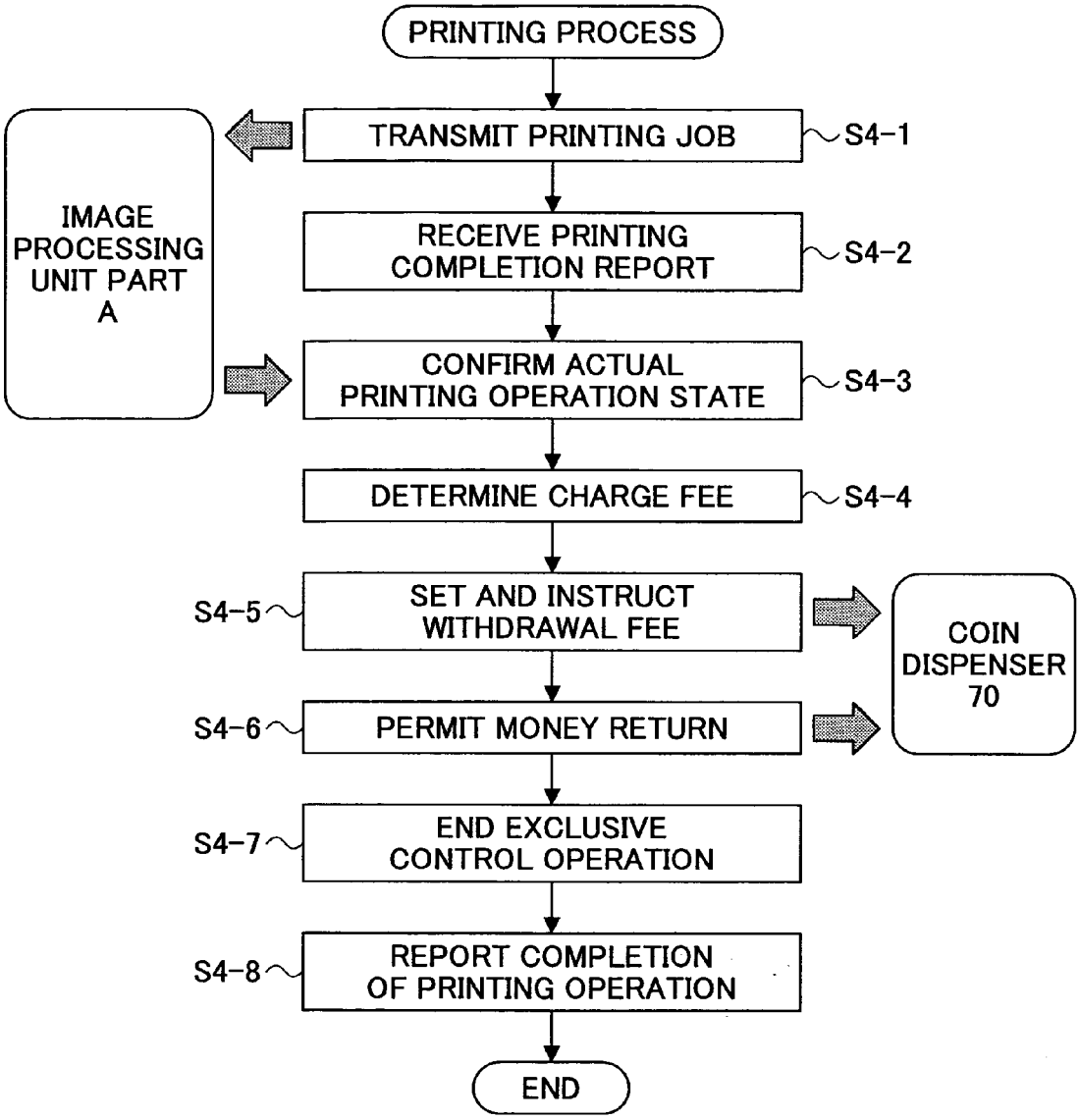
FIG. 7 is a diagram for describing a process of an operation according to an embodiment of the present invention.
Figure 8:
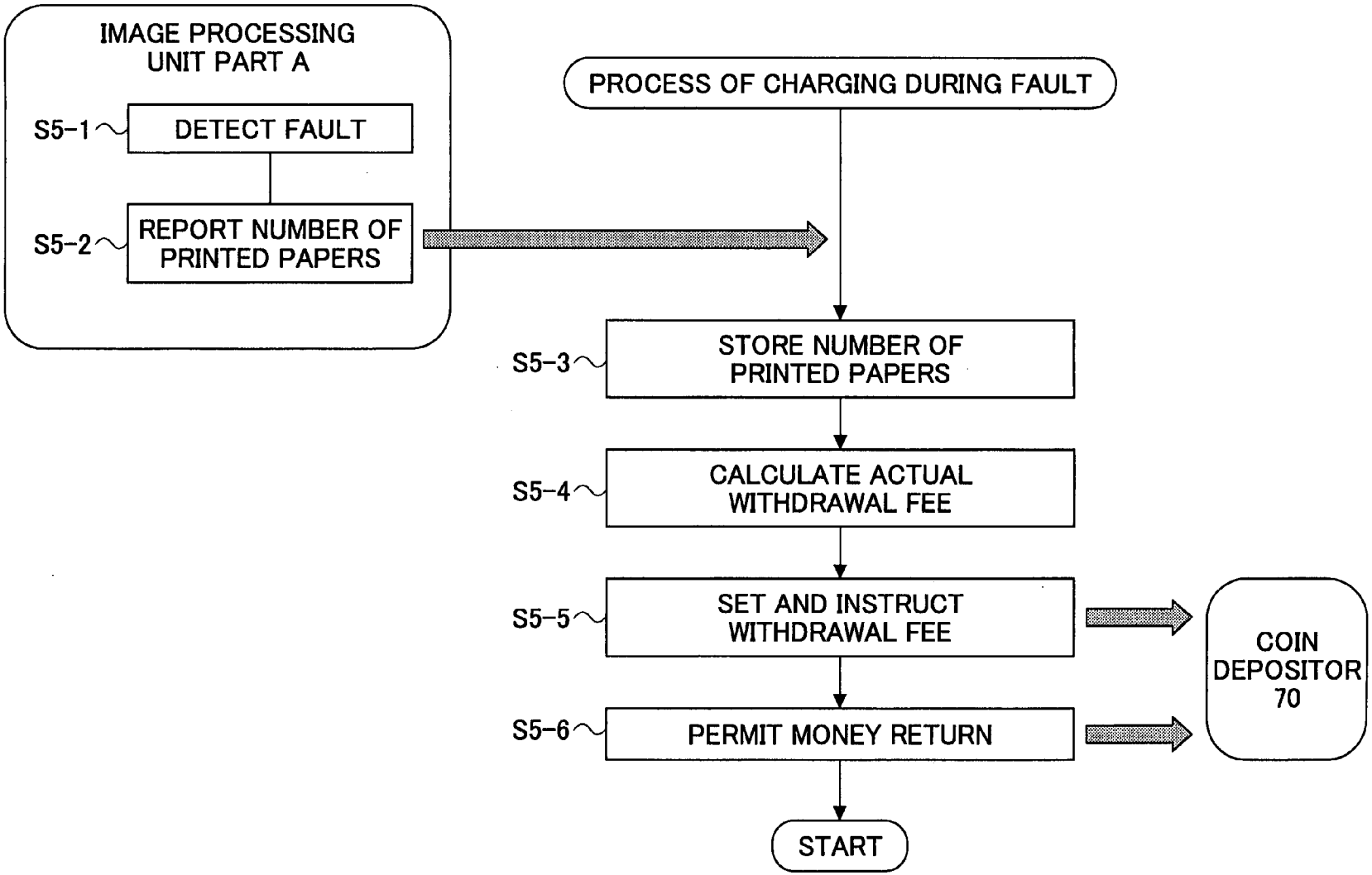
FIG. 8 is a diagram for describing a process of an operation according to an embodiment of the present invention.

Next, a procedure of executing a printing operation by using the above-described exemplary system according to an embodiment of the present invention is described with reference to FIGS. 4 through 14, in which image data prepared by the user are printed by using a format selected by the user. Here, FIG. 4 shows a process of selecting contents, FIG. 5 shows a process of detecting shortage of change, FIG. 6 shows a process of determining charge prior to a printing operation, FIG. 7 shows a printing process, and FIG. 8 shows a process of charging in a case of a fault.

(Contents Selection Process)

First, a process of selecting contents is described. The user, who desires to print desired image data with a format prepared by the image forming apparatus 20, prepares a recording medium which has the user's desired image data recorded thereto.

It is to be noted that image data stored in the network may be employed as an alternative of the image data recorded in the recording medium.

Then, the user performs the below-described operation with the control panel P. Prior to performing the below-described operation, an initial screen 80 is displayed on the display apparatus 50 of the control panel P, as shown in FIG. 9.

Figure 9:
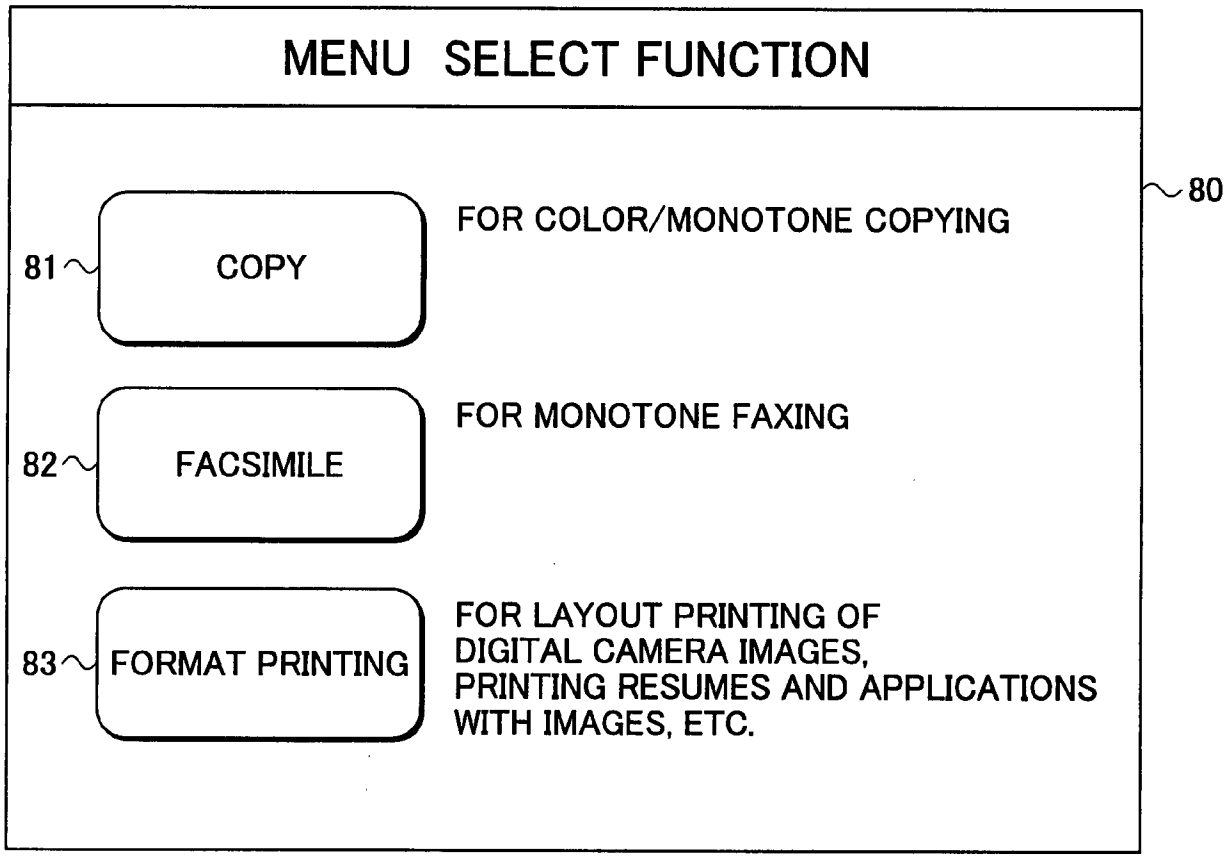
FIG. 9 is a diagram for describing a display screen displayed on a display control part of an image forming apparatus according to an embodiment of the present invention.

The initial screen 80 displays a copy function selection button 81, a facsimile function selection button 82, and a format printing service selection button 83, as shown in FIG. 9.

The copy function selection button 81 is employed for selecting a copying function. The facsimile function selection button 82 is employed for selecting a facsimile function. The format printing service selection button 83 is employed for selecting a format printing service. In this example, the format printing service is selected with the format printing service selection button 83. In accordance with the selected format printing service, the image processing unit part B displays a recording medium selection screen (not shown) on the display apparatus 50.

In accordance with the type of the selected recording medium, the image processing unit part B displays. a recording medium insertion instruction(s) corresponding to the type of the selected recording medium on the display apparatus 50. The user inserts the prepared recording medium into the outside media input/output apparatus 23 in accordance with the insertion instruction.

When the user's recording medium is inserted into the outside media input/output apparatus 23, the information processing unit B starts the contents selection process, in accordance with the procedure shown in FIG. 4. It is to be noted that an error is displayed on the control panel P when the selected recording medium and the inserted recording medium do not match.

First, the management computer 41 in the information processing unit part B executes a format selection operation with the overall control part 60 (Step S1-1). The format selection operation is described in further detail below.

Figure 10:
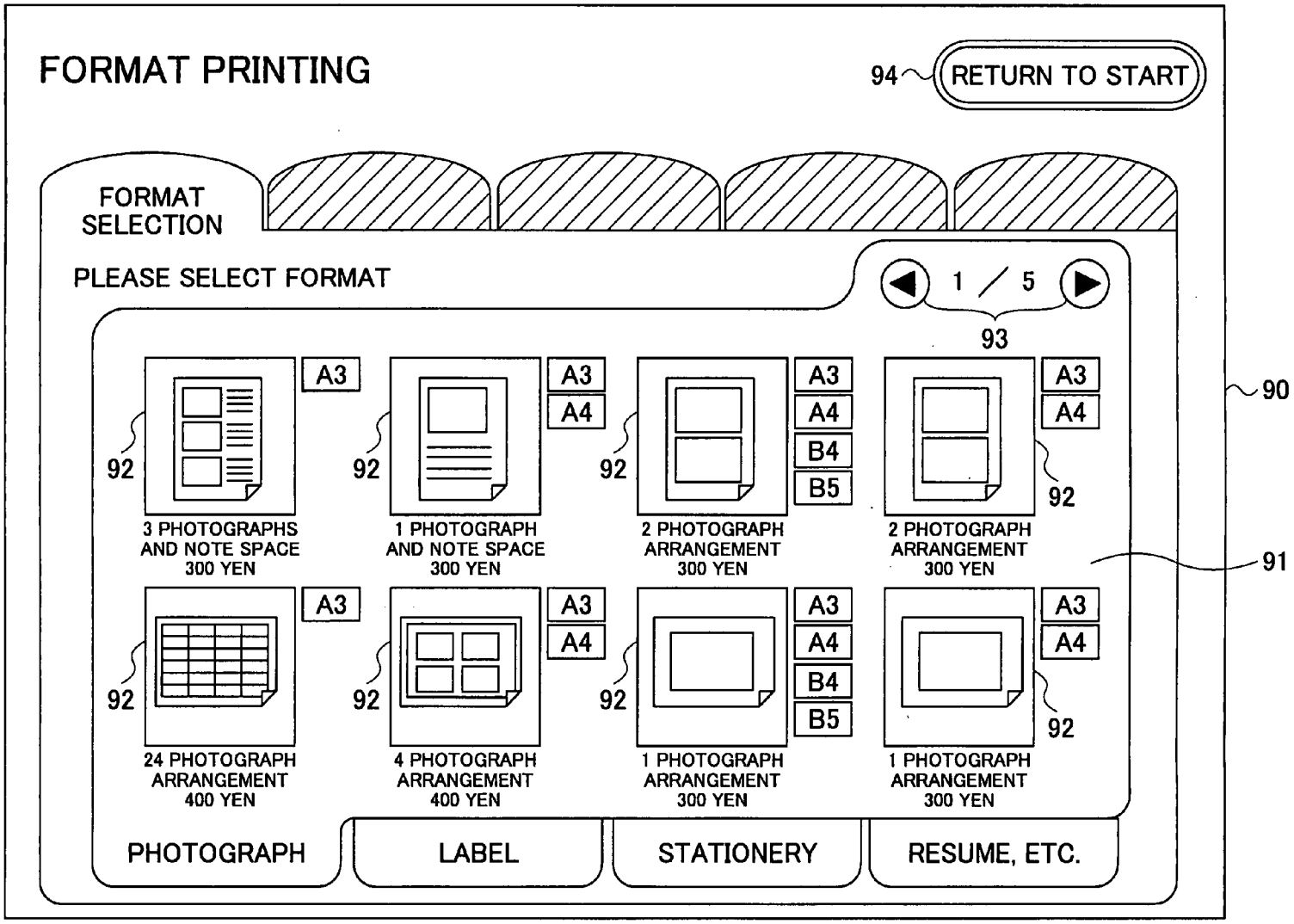
FIG. 10 is a diagram for describing a display screen displayed on a display apparatus of an image forming apparatus according to an embodiment of the present invention.

First, the image processing unit part B displays a format selection screen 90 on the display apparatus 50, as shown in FIG. 10.

A format listing display part 91 corresponding to a selected category is displayed in the format selection screen 90, as shown in FIG. 10. The category of the formats includes, for example "photographs", "labels", "stationery", and "resumes, etc." In this example, the category "photographs" is selected. Accordingly, the format listing display part 91 corresponding to the category "photographs" is displayed.

The format listing display part 91 displays format selection icons 92 corresponding to the selected category. The printable sizes of paper are displayed on the right side of each icon 92 (for example, A3 size, A4 size). The names of the formats (format names) are displayed on the bottom side of each icon 92. Furthermore, a page flipping button 93 is provided in the format listing display part 91. By flipping pages with the page flipping button 93, other formats belonging to the selected category are displayed in the format listing display part 91.

The category tabs displayed in the bottom part of the format listing display part 91 (e.g. "photographs", "labels", "stationery" etc.) correspond to the format category names in the contents catalogue data 660. When one of the category tabs is selected, the management computer 41 extracts from contents catalogue data 660 format names corresponding to the category of the selected category tab based on the format category names. Then, icon file names corresponding to the extracted contents catalogue data 660 are extracted, and icon files are extracted from the icon memory part (not shown) based on the extracted icon file names; thereby the icons 92 are displayed on the format listing display part 91. Furthermore, the management computer 41 allows the format name and the format usage fee to be displayed at the bottom side of the corresponding icon 92 based on the contents catalogue data 660 regarding format names and format usage fees. The management computer 41 also allows sizes and types of paper to be displayed based on the contents catalogue data 660 regarding paper. It is to be noted that the same types of paper are set to each of the paper data spaces in the extracted contents catalogue data 660. Therefore, in this example, only the sizes of paper are displayed. It is to be noted that an initial screen display button 94 is provided in the format selection screen 90. The initial screen display button 94 is used for returning to the initial screen 81.

Accordingly, by depressing any one of the icons 92, a desired format is selected. More specifically, by depressing any one of the icons 92, selected format data, which include information that uniquely identifies names of format templates, icon files, etc., are transmitted to the management computer 41.

When the management computer 41 receives the selected format data, the management computer 41 obtains the contents catalogue data 660 corresponding to the depressed icon 92 by using the overall control part 60 based on the selected format data (Step S1-2). Then, the overall control part 60 extracts the contents source data corresponding to the contents catalogue data 660 from the contents source data memory part 67 (Step S1-3). More specifically, the overall control part 60 extracts the contents source data from the contents source data memory part 67 based on the format template file name in the contents catalogue data 660.

In a case where the repetitive printing flag in the contents catalogue data 660 is set to "active", the overall control part 60 allows a printing type selection screen (not shown) to be displayed on the display apparatus 50 for requesting selection of either repetitive printing or discrete printing. An icon for selecting repetitive printing and an icon for selecting discrete printing are displayed on the printing type selection screen. Here, the "repetitive printing" is a type of printing in which a single selected image is repetitively set and printed in multiple image setting parts in a format(s). The "discrete printing" is a type of printing in which multiple selected images are discretely set and printed in respective image setting parts in a format(s). When one of the icons for repetitive printing or discrete printing is depressed, selected data for repetitive printing are transmitted to the management computer 41. The overall control part 60 temporarily stores the selected data. This example is described as a case where discrete printing is selected as the type of printing.

Next, the overall control part 60 executes a process of temporarily storing data regarding the size of paper designated by the user (Step S1-4). More specifically, the overall control part 60 allows a paper size selection screen 100 to be displayed on the display apparatus 50, as shown in FIG. 11.

Figure 11:
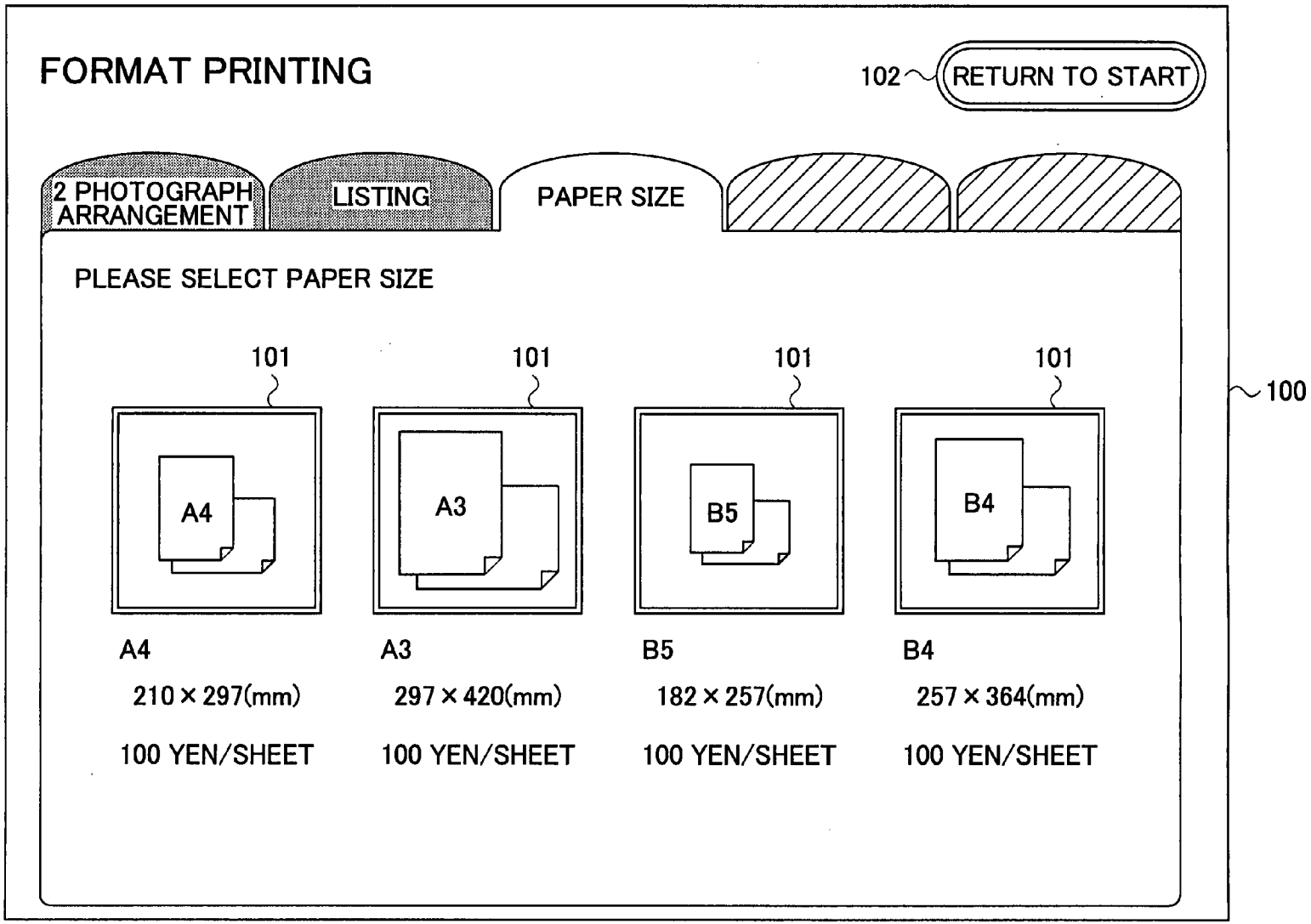
FIG. 11 is a diagram for describing a display screen displayed on a display apparatus of an image forming apparatus according to an embodiment of the present invention.

In FIG. 11, the paper size selection screen 100 displays an icon(s) 101 indicating sizes of paper that are printable for the format selected with the format selection screen 90 of FIG. 10. Furthermore, paper sizes and printing fees are displayed the bottom side of each of the icons 101. Furthermore, an initial screen display button 102 is displayed on the upper right part of the paper size selection screen 100. The initial screen display button 102 is used when returning to the initial screen 80.

More specifically, a paper size that is printable for the selected format is identified based on paper data in the contents catalogue data 660. Furthermore, the printing fee is displayed based on the printing fee data in the contents catalogue data 660.

The user selects the paper size by depressing one of the icons 101 in the display apparatus 50. Accordingly, data of the selected paper size are transmitted to the management computer 41. When the management computer 41 receives the data, the overall control part 60 in the management computer 41 temporarily stores the data of the selected paper size.

Next, the overall control part 60 reads image data and/or text data in the recording medium inserted into the outside media input/output apparatus 23 by the user. It is to be noted that the overall control part 60 allows an error signal to be displayed on the control panel P via the display control unit 46 when the data cannot be read from the recording medium. Then, the overall control part 60 allows an image(s) to be displayed on the display apparatus 50 based on the read data (Step S1-5). More specifically, a photograph selection screen (image selection screen) 110 is displayed on the display apparatus, as shown in FIG. 12.

Figure 12:
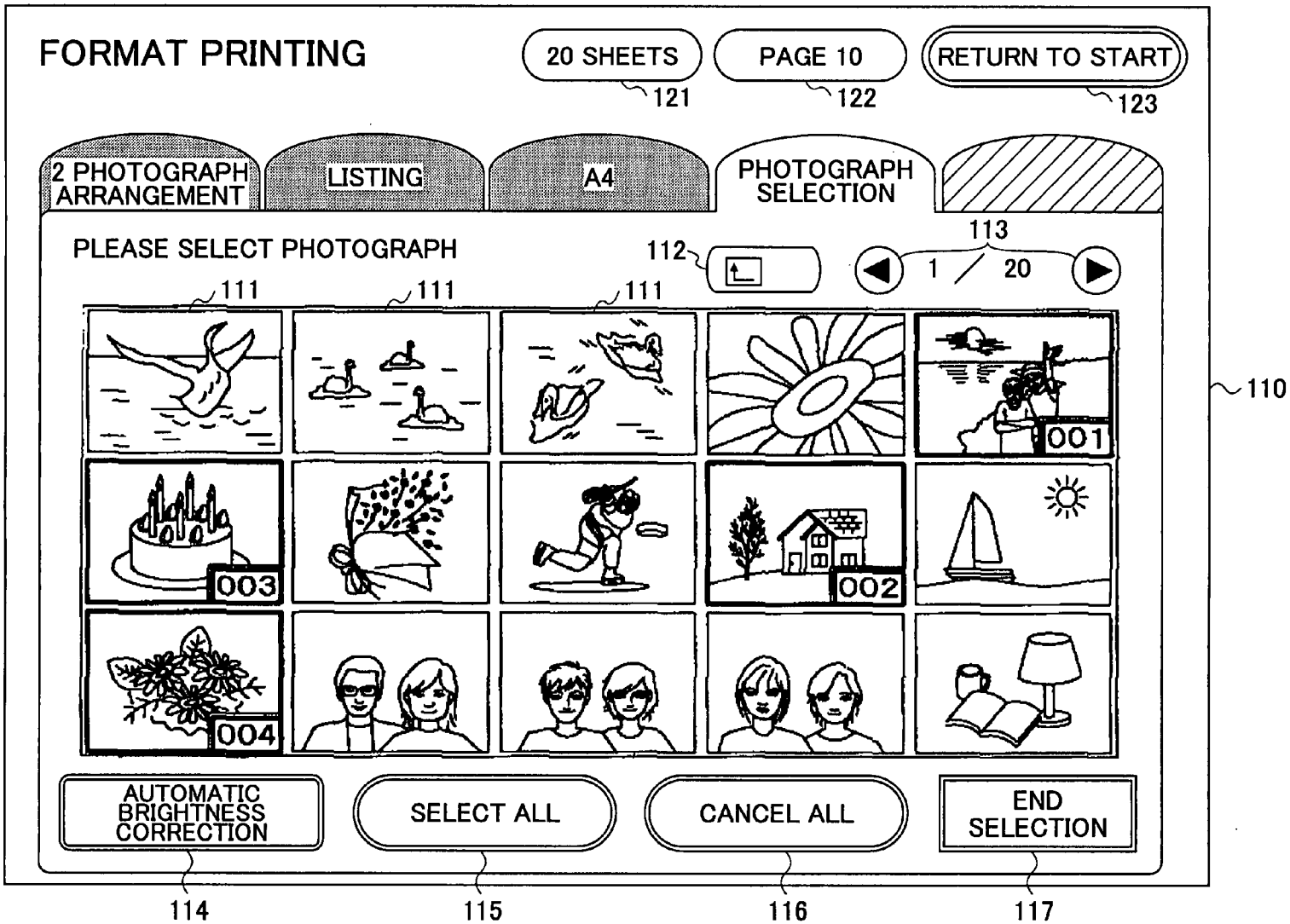
FIG. 12 is a diagram for describing a display screen displayed on a display apparatus of an image forming apparatus according to an embodiment of the present invention.

In FIG. 12, photograph buttons 111 (15 photograph buttons in this example) are displayed on the photograph selection screen 110. Images are displayed as thumbnails in the photograph selection screen 110 based on the data (e.g. image data) read from the recording medium inserted into the outside media input/output apparatus 23. Furthermore, the photograph selection screen 110 is also provided with an upper level button 112, a page flipping button 113, an automatic brightness compensation button 114, an all-select button 115, an all-cancel button 116, and a selection end button 117. Furthermore, a sheet count display space 121, a page display space 122, and an initial screen display button 123 are provided on the upper part of the photograph selection screen 110.

The photograph buttons 111 are employed for selecting a printing target(s) from the images on the photograph selection screen 110. When selection is made by depressing the photograph buttons 111, numbers which indicate the order of the selection are displayed at the bottom right parts of the photograph buttons 111. The upper layer button 112 is employed for accessing a folder located at an upper level. The page flipping button 113 is employed for flipping a page. The automatic brightness compensation button 114 is employed for automatically compensating the brightness of the images. The all-select button 115 is employed for selecting all of the images (image files). The all-cancel button 116 is employed for canceling selection of an image (s). The selection end button 117 is employed for ending the selection of the images. The number of sheets of photographs that are to be printed is displayed in the sheet count display space 121. The number of sheets of papers on which images are printed is displayed in the page display space 122. The initial screen display button 123 is employed for returning to the initial screen 80.

When the photograph button(s) 111 in the photograph selection screen 110 is depressed, the overall control part 60 temporarily stores the selected image data as a first data item in the user data memory part 65 (Step S1-6). More specifically, when the photograph button is depressed, the selected image data item is transmitted to the management computer 41. When the image data item is received by the management computer 41, the overall control part 60 in the management computer 41 associates the image data item with its corresponding order number (order in which the image data item is selected) and stores the image data item along with the associated order number.

Next, the management computer 41 allows the contents processing part 61 to execute a processing operation (image processing operation) using the contents source and the image data (Step S1-7). Thereby, the selected image is set to the selected format.

More specifically, in this example, the contents processing part 61, first, reads the image data item and its corresponding order number stored in the user data memory part 65. Then, the contents processing part 61 sets the contents source data extracted in Step S1-3 to the read data (e.g. image data) in an order desired by the user. It is to be noted that in a case where only a single electronic data item can be set to the contents source data, the order of setting the electronic data is unnecessary. Accordingly, selected electronic data (e.g. image data) can be set to the selected format.

Furthermore, in a case where multiple electronic data items can be set to the contents source data, selected multiple electronic data items can be set to the selected format in the selected order since the electronic data items (e.g. image data) are stored associated with the order number in the user data memory part 65.

It is to be noted that the image processing operation of the contents processing part 61 may be executed in an exemplary manner described below.

In a case where the image data item is a photograph of a person, skin color correction, color correction (e.g. white balance), and/or lightness and chroma correction may be executed. By enabling the image forming apparatus 20 to perform the compensation process, the user can operate the image forming apparatus 20 with anticipation of the output result.

In the image processing operation, the size of the image data item may be changed, or a portion of the image data item may be cut out.

Furthermore, in a case where formats of covers for various media (e.g. book, DVD, CD, etc.) is provided, dotted-lines or cutoff lines may be printed on the back of the covers in correspondence with the size of the media (e.g. book, DVD, CD, etc.). Accordingly, by following the printed dotted line or cutoff line, the user can obtain a desired cover without having to consider the position for folding or cutting out the sheet used for the cover. It is to be noted that the lines are printed on the back of the sheet so that the printed lines do not affect the contents (e.g. format), to thereby provide convenient use for the user.

Then, the contents processing part 61 provides a preview display of a print image in accordance with the processed information (Step S1-8). More specifically, a preview screen 130 is displayed on the display apparatus 50, as shown in FIG. 13.

Figure 13:
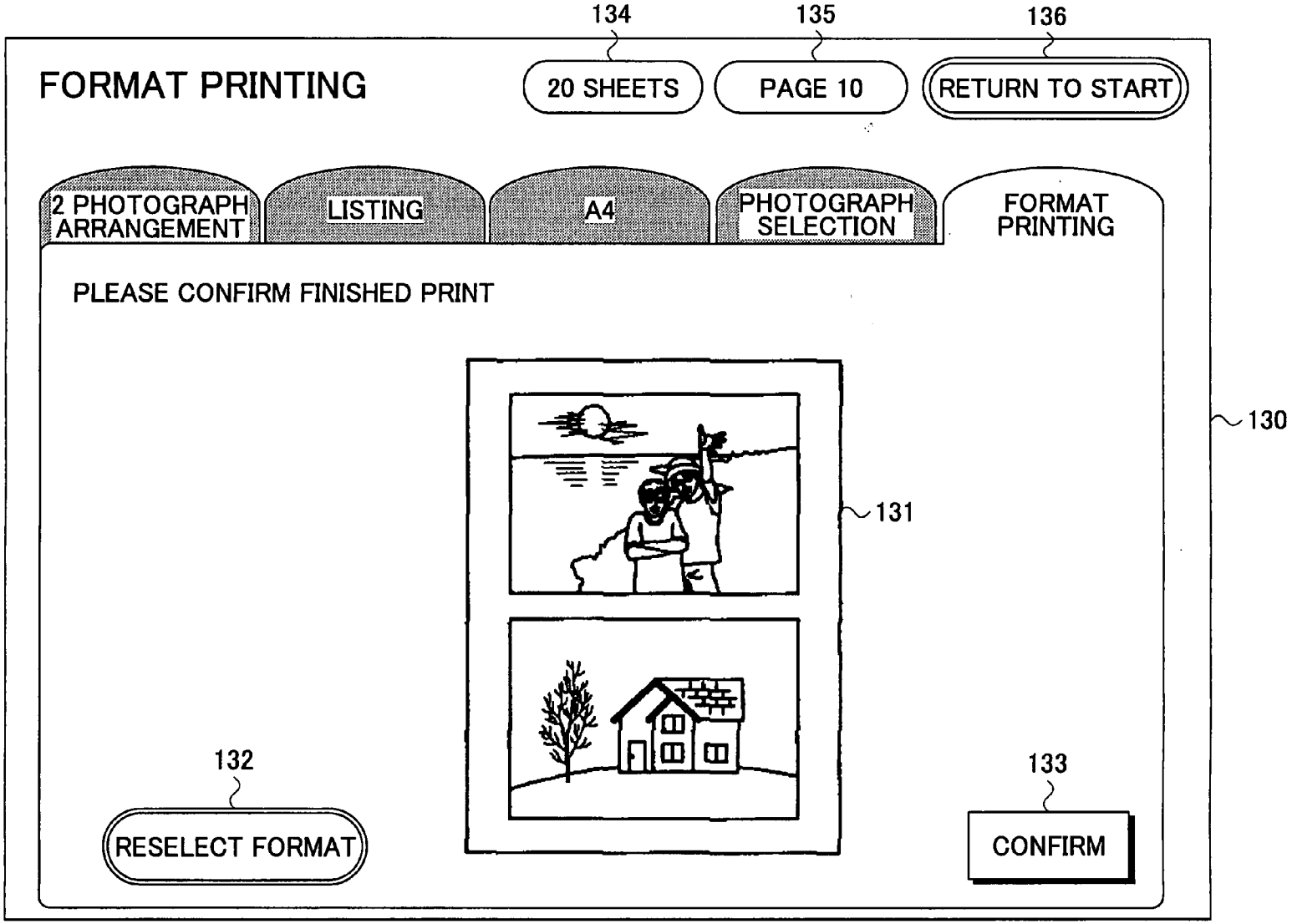
FIG. 13 is a diagram for describing a display screen displayed on a display apparatus of an image forming apparatus according to an embodiment of the present invention.

In FIG. 13, a print image 131 is displayed in the preview screen 130. Furthermore, the preview screen 130 is provided with a format reselection button 132, a confirmation button 133, a sheet count display space 134, a page display space 135, and an initial screen display button 136.

On a top page of the print image 131, an image(s) attached to the selected format is displayed. The format reselection button 132 is employed for reselecting a format. The confirmation button 133 is employed for confirming that there is no problem with the print image 131 and proceeding to a next operation. The initial screen display button 136 is employed for returning to the initial screen 80.

In this example, confirmation data are transmitted to the management computer 41 when the confirmation button 133 is depressed. Upon receiving the confirmation data, the management computer 41 initiates an operation for setting the print amount (number of copies). More specifically, overall control part 60 in the management computer 41 allows a print amount setting screen 140 to be displayed on the display apparatus 50, as shown in FIG. 14.

Figure 14:
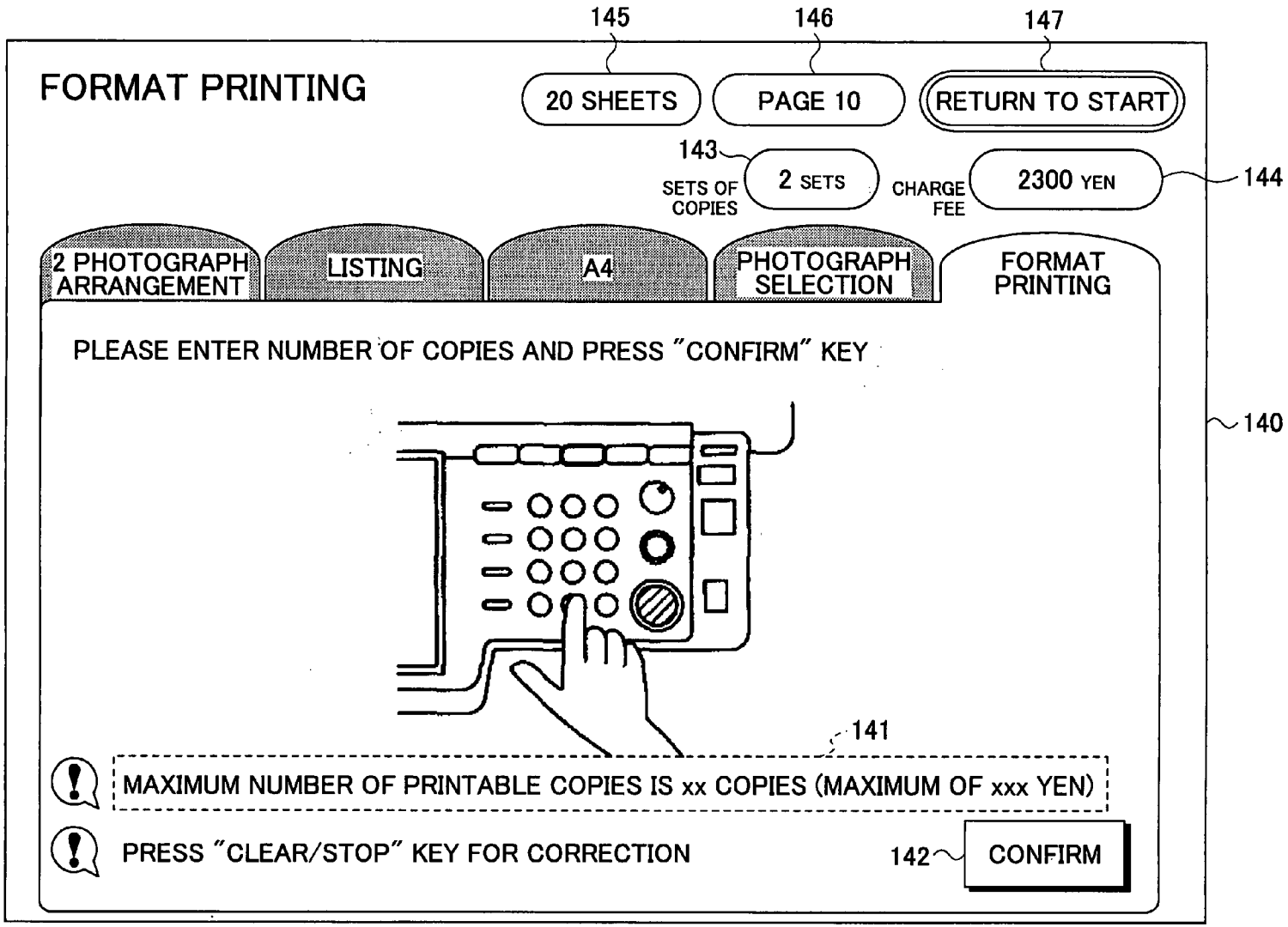
FIG. 14 is a diagram for describing a display screen displayed on a display apparatus of an image forming apparatus according to an embodiment of the present invention.

In FIG. 14, an instruction requesting setting of a print amount (number of copies) is displayed on the print amount setting screen 140. In accordance with the instruction, the user inputs a desired print amount with the input operation apparatus 51. The print amount setting screen 140 is also provided with a maximum print amount/charge fee display 141 (display for indicating maximum printable amount and its corresponding charge) and a confirmation button 142. Furthermore, the print amount setting screen 140 is also provided with a print amount display space 143, a charge display 144, a sheet count display space 145, a page display space 146, and an initial screen display button 147 for returning to the initial screen 80.

When the user inputs the print amount, data of the input print amount are transmitted to the management computer 41. When the management computer 41 receives the print amount data, the overall control part 60 of the management computer 41 sets the input print amount (Step S1-9). The overall control part 60 determines the charge fee by referring to the extracted contents catalogue data 660 (S1-10). More specifically, the overall control part 60 calculates the charge fee corresponding to the print amount (second charge fee) based on the print amount and the print fee included in the contents catalogue data 660. Furthermore, the overall control part 660 obtains the format usage fee (first charge fee) included in the contents catalogue data 660. Then, the overall control part 60 adds together the calculated charge fee corresponding to the print amount (second charge fee) and the obtained format usage fee (first charge fee). Thereby, the charge fee for charging the user (total charge fee) can be determined.

Then, the overall control part 60 allows the determined charge fee to be displayed on the display apparatus 50 and instructs depositing of the charge fee (Step S1-11). More specifically, the set print amount is displayed in print amount display space 143 in the print amount setting screen 140. Furthermore, the determined charge fee is displayed in the charge display 144. Then, the user depresses the confirmation button 142 after confirming the displayed print amount and charge fee. Then, confirmation data of the print amount and charge fee are transmitted to the management computer 41. Upon receiving the confirmation data, the management computer 41 allows the instruction for depositing the charge fee to be displayed on the display apparatus 50.

(Process of Determining Shortage of Change)

In accordance with the instruction for depositing the charge fee, the user deposits money in the coin dispenser 70. In this example, the information processing unit part B determines whether shortage of cash will occur when the user deposits money to the coin dispenser 70. Here, in order to prevent cancellation of the printing operation due to shortage of change, the information processing unit part B determines whether shortage of change will occur with respect to the entire number of sheets. This process is described below with reference to FIG. 5.

In determining the shortage of change, the overall control part 60 of the management computer 41 reports the charge fee confirmed by the user to the coin dispenser management part 62 and instructs commencement of the change shortage determination process. Furthermore, the overall control part 60 calculates the charge fee supposing a case where printing of one sheet each is cancelled, wherein the entire number of sheets is the upper limit. Then, the overall control part 60 reports the calculated charge fee to the coin dispenser management part 62.

As shown in FIG. 5, upon receiving the report from the overall control part 60, the coin dispenser management part 62 starts an exclusive control operation with respect to all other services (Step S2-1). Thereby, the image formation apparatus 20 ceases to accept other services.

Then, the coin dispenser management part 62 stores (sets) the charge fee received from overall control part 60 for executing the change shortage determination process (Step S2-2). More specifically, the coin dispenser management part 62 temporarily stores the total charge fee of the entire number of sheets confirmed by the user and the charge fee in the case of reducing the printing in steps of one sheet each.

Then, the coin dispenser management part 62 determines the state of the coin dispenser 70 via the charge I/F board 75. More specifically, the coin dispenser management part 62 determines the state of the change prepared (stored) in the coin dispenser 70 (Step S2-3). Then, the coin dispenser management part 62 determines the state of the user's money deposited to the coin dispenser 70 (Step S2-4).

Then, the coin dispenser management part 62 determines whether there is sufficient change based on the change stored in the coin dispenser 70 and the money deposited by the user (Step S2-5). In this example, it is determined whether there is sufficient change for reduced printing in steps of one sheet each. That is, other than determining whether there is sufficient change after completion of the printing operation, there may also be a situation of determining whether there is sufficient change in a case where the printing is cancelled in the midst of the printing operation. Then, the coin dispenser management part 62 reports the results of the determination of change to the overall control part 60.

In a case where there is a sufficient amount of change (YES in Step S2-6), the overall control part 60 allows (sets) the user to command execution of the printing operation (Step S2-7). In this example, the overall control part 60 allows the display apparatus 50 to display an instruction for guiding the user to depress a start key for commanding execution of the printing operation and allows the start key to be a depressible state.

In a case where there is insufficient amount of change (NO in Step S2-6), the overall control part 60 allows the display apparatus 50 to display an error signal and prohibits the user from commanding execution of the printing operation (S2-8).

Furthermore, the coin dispenser management part 62 ends the exclusive control operation (S2-9). Thereby, the image forming apparatus 20 commences acceptance of other services.

(Process of Determining Charge Prior to Printing Operation)

When the instruction for guiding the user to depress the start key for commanding execution of the printing operation is displayed on the display apparatus 50, the user, accordingly, depresses the start key. When the start key is depressed, the input of the command for executing the printing operation is reported to the management computer 41. Upon receiving the report, the management computer 41 commences a process of determining charge prior to printing operation. The process is described below with reference to FIG. 6.

In FIG. 6, upon receiving the command for executing the printing operation, the overall control part 60 instructs the coin dispenser management part 62 to execute a charge determination operation (Step S3-1). Then, the coin dispenser management part 62 starts the exclusive control operation with respect to all other services (Step S3-2). Thereby, the image forming apparatus 20 ceases to accept requests for other services. Then, the coin dispenser management part 60 sets the charge fee received from the overall control part 62 as the fee for charging the user (Step S3-3).

Next, the coin dispenser management part 62 sets the coin dispenser to a refund prohibiting state via the charge I/F board 75 (Step S3-4). Then, the coin dispenser management part 62 determines the state of the coin dispenser 70 via the charge I/F board 75. More specifically, the coin dispenser management part 62 determines the state of the change prepared in the coin dispenser 70 (Step S3-5). Next, the coin dispenser management part 62 determines the money deposited in the coin dispenser 70 (Step S3-6). Then, the coin dispenser management part 62 determines whether the charge fee can be charged by referring to the state of the coin dispenser 70 (Step S3-7), and reports the determination results to the overall control part 60.

In a case where the charge fee can be charged (YES in Step S3-8), the overall control part 60 proceeds to the printing operation (Step S3-9). The printing process is described below with reference to FIG. 7.

Meanwhile, in a case where the charge fee cannot be charged (NO in Step S3-8), the coin dispenser management part 62 sets a money return part (in this example, a return lever) of the coin dispenser 70 to an operable state via the charge I/F board 75 (Step S3-10). Thereby, the user is able to have the deposited money returned from the coin dispenser 70 by using the refund lever. The exclusive control operation with respect to other services is ended when the refund lever is used (Step S3-11). Thereby, the image forming apparatus 20 commences acceptance of other services. Furthermore, the overall control part 60 allows the display apparatus 50 to display an instruction for instructing the user to deposit the charge fee (Step S3-12). Subsequent to Step S3-12, the process returns to Step S1-10 of the contents selection process shown in FIG. 4.

(Printing Process)

Next, the printing process is described with reference to FIG. 7.

In FIG. 7, the overall control part 60 transmits a printing job to the image processing unit part A via the print control part 63 (Step S4-1). More specifically, the overall control part 60 transmits a printing job including a subject image forming information and a process command to the image processing unit part A via the LAN control part 55, the HUB 56, and the LAN control part 54. Upon receiving the printing job, the image processing unit part A commences a printing operation. Then, after the printing operation is completed, the image processing unit part A reports completion of the printing operation to the information processing unit part B.

Upon receiving the printing completion report from the image processing unit part A (Step S4-2), the print control part 63 reports reception of the printing completion report to the overall control part 62. In accordance with the printing completion report, the overall control part 60 confirms the actual printing operation state (Step S4-3), and determines the fee to be charged to the user (Step S4-4). Then, the overall control part 60 reports the fee that is to be charged (withdrawn) to the coin dispenser management part 62.

Upon receiving the report, the coin dispenser management part 62 determines (sets) the fee that is to be withdrawn and instructs the coin dispenser 70 to withdraw the fee via the charge I/F board 75 (Step S4-5). Accordingly, the coin dispenser 70 withdraws the determined fee. Furthermore, the coin dispenser management part 62 permits the coin dispenser 70 to return money via the charge I/F board 75 (Step S4-6). Accordingly, the user is able to receive change from the coin dispenser 70.

Furthermore, the coin dispenser management part 62 ends the exclusive control operation with respect to the other services (Step S4-7). Accordingly, the image forming apparatus 20 commences acceptance of other services. Then the coin dispenser management part 62 reports the completion of the charging executed by the coin dispenser 70 to the overall control part 60.

Upon receiving the charging completion report, the overall control part 60 reports the completion of the printing operation to the user (Step S4-8). More specifically, the overall control part 60 allows the display apparatus 50 to display a message indicating completion of the printing operation and a message reminding the user not to forget retrieval of change. Furthermore, the overall control part 60 may allow a voice output apparatus (not shown) to output a message reporting completion of the printing operation and a message reminding the user not to forget retrieval of change.

(Process of Charging in a Case of a Fault)

In some situations, there may be a case where the printing operation is interrupted (cancelled) after the printing operation is started. For example, in printing large amounts of paper, the printing operation may be interrupted by, for example, occurrence of a fault (e.g. jamming of paper) or shortage of paper supply. Furthermore, the user may input a request for canceling the printing operation by depressing a stop key in the input control apparatus 51. In such cases, only a portion of the sheets anticipated for printing is printed. The charging process for such cases is described with reference to FIG. 8. Here, the charging process is described in a case where a fault occurs in the image processing unit part A.

As shown in FIG. 8, first, the image processing unit part A detects a fault, such as paper jam (Step S5-1). Then, the image processing unit part A obtains the number of printed papers (counted each time a paper is discharged) from the print control unit 31. In this example, the print control unit 31 counts the number of actually printed papers from the initiation of the printing job to the occurrence of the fault. Then, the image processing unit part A reports the number of papers, which have been printed until the occurrence of the fault, to the information processing unit part B via the charge I/F board 75 (Step S5-2).

Upon receiving the report from the image processing unit part A, the overall control part 60 in the information processing unit part B temporarily stores the reported number of printed papers (Step S5-3). Then, the overall control part 60 calculates (obtains) the fee to be actually withdrawn based on the number of printed papers (Step S5-4). More specifically, the overall control part 60 first extracts contents catalogue data 660 corresponding to the contents source data used in the printing operation, from the contents catalogue data memory part 66. Then, the overall control part 60 extracts the print fee corresponding to the size of the printed papers. Then, the overall control part 60 multiplies the extracted print fee by the number of printed papers, to thereby obtain the print fee with respect to the printed papers. Furthermore, the overall control part extracts the format usage fee in the contents catalogue data 660 and adds the extracted format usage fee to the print fee. Accordingly, the overall control part 60 obtains the actual amount to be withdrawn. Then, the overall control part 60 reports the actual amount to be withdrawn to the coin dispenser management part 62.

Then, the coin dispenser management part 62 sets the amount of withdrawal and instructs the coin dispenser 70 to withdraw the reported amount via the charge I/F board 75 (Step S5-5). Furthermore, the coin dispenser management part 62 permits the coin dispenser 70 to return money via the charge I/F board 75 (Step S5-6). Accordingly, the user is able to receive change from the coin dispenser 70. It is to be noted that the coin dispenser management part 62 ends the exclusive control operation with respect to the other services. Accordingly, the image forming apparatus 20 commences acceptance of other services.

With the above-described embodiment according to the present invention, the below-given advantages can be obtained.

With the above-described embodiment according to the present invention, the management computer 41 can apply the image data selected by the user to the contents catalogue source data of the format selected by the user. Then, in executing the printing operation using the catalogue source data, the charge fee is calculated by using the data of the format usage fee and the print fee in the contents catalogue data 660. Then, the calculated charge fee is withdrawn from the money deposited in the coin dispenser 70 by the user. Accordingly, a desired image can be set and printed to a desired format. Furthermore, by using the contents catalogue data 660 in calculating the charge fee, the charge fee can be set flexibly. Furthermore, by using the coin dispenser 70 for withdrawing the charge fee, the charge fee can be collected at the same location where the format printing is executed with the image forming apparatus 20.

Furthermore, the contents catalogue data 660 include data of print fees and format usage fees. Furthermore, the management computer 41 calculates the charge fees in correspondence with the formats by referring to the format usage fees. Furthermore, the management computer 41 calculates the print fees in correspondence with the paper size and the print amount (number of copies) by referring to the print fees. Accordingly, the charging can be executed in accordance with the format that is used and the manner of printing. Therefore, the charging can be suitably executed according to circumstance and the charge fee can be set flexibly.

Furthermore, the image forming apparatus 20 determines the state of change and the money deposited in the coin dispenser 70 before executing the printing operation. In a case of printing plural sheets, charge fees are calculated for a case where an operation of printing the sheets in a batch is interrupted (cancelled) and for a case where an operation of printing sheet-by-sheet is interrupted (cancelled). Furthermore, it is determined whether there is a sufficient amount of change when the sheet-by-sheet printing operation is interrupted by referring to the calculated charge fee and the available change in the coin dispenser 70. Furthermore, the printing operation is cancelled in a case where the change is insufficient. This enables anticipation of shortage of change in the middle of printing plural papers. Thus, the printing operation is not commenced unless the shortage of change is resolved. Accordingly, shortage of change can be prevented from occurring even in a case where the printing operation is interrupted.

Furthermore, the management computer 41 compares the amount of money deposited in the coin dispenser 70 by the user with the amount of the calculated charge fee. The printing operation is executed only when the money deposited to the coin dispenser 70 is same as or greater than the calculated charge fee. Therefore, the printing operation is not executed in a case where the user does not deposit a sufficient amount of money in the coin dispenser. This prevents a problem of being unable to collect the calculated charge fee.

Furthermore, the management computer 41 receives a report from the image processing unit part A, reporting the number of copies printed in a case where the printing operation of the image processing unit part A is interrupted. The management computer 41 calculates the charge fee corresponding to the reported number of copies. Then, the management computer 41 instructs withdrawal of a fee amounting to the calculated charge fee to the coin dispenser 70. Accordingly, even in a case where the printing operation of the image forming apparatus is interrupted, a charge fee corresponding to the printed amount can be calculated and collected.

The above-described embodiment of the present invention may be modified to another embodiment of the present invention described below.

In the above-described embodiment of the present invention, the charge fee is charged in accordance with the type of paper and the number of copies. Alternatively, in the other embodiment of the present invention, the charging of the charge fee is executed in accordance with a time period in which the printing operation is executed.

Figure 15:
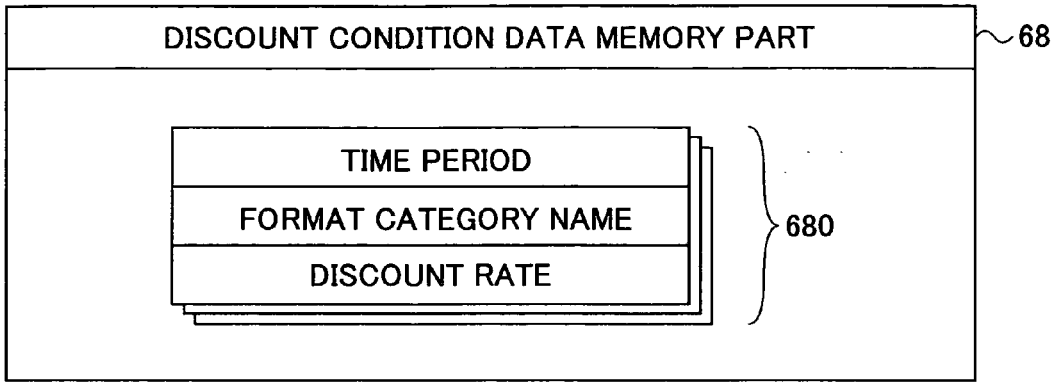
FIG. 15 is a diagram for describing data stored in a discount condition data memory part according to an embodiment of the present invention.

For example, a discount rate may be set in correspondence with a predetermined time period, to thereby discount the charge fee in accordance with the discount rate when the printing operation is executed in the predetermined time period. In this embodiment of the present invention, a discount condition data memory part A can be provided in the memory apparatus 43, as shown in FIG. 15. The discount condition data memory part A stores discount condition data 680 with respect to each time period and format. The discount condition data 680 includes data of time periods, format category names, and discount rates. The space including the data of the time period stores time periods to which the discount rates in the discount condition data 280 are applied. The space including the data of the format category names stores the names of formats to which the discount rates are applied. The space including the data of the discount rates stores discount rates corresponding to time periods and format category names.

Accordingly, in executing the printing operation, the present time is obtained and the discount condition data 680, which corresponds to the time period including the present time and a target format category name, is extracted. Then, the calculated charge fee is multiplied with the discount rate, to thereby obtain a discounted charge fee.

Accordingly, a diverse charge fee can be charged in accordance with the time period of executing the printing operation. It is to be noted that the discount rate may also be set with respect to the format usage fee or the print fee. Furthermore, the discount rate may alternatively be set with respect to each format instead of each format category. Accordingly, the charge fee can be set flexibly.

Furthermore, the data regarding the time period (effective time period) can be stored in correspondence with the data of the format usage fees and the print fees. Accordingly, in a case where the present time falls in the effective time period, the charge fee can be calculated by referring to the format usage fee and the print fee. It is to be noted that in a case where the present time does not fall in the effective time period, the charge fee can be calculated by referring to the format usage fee and the print fee in a case of a regular format. Accordingly, the format usage fee and the print fee can be set flexibly with respect to the effective time period. Therefore, a diverse charge fee can be charged.

In the above-described embodiments according to the present invention, the added total of the format usage fee and the print fee is collected as the charge fee in the case where the image of the user is set to the format and printed. In this case where the printing operation is executed as the image forming operation, the charge fee is collected with the coin dispenser 70 when the printing operation is executed. Alternatively, an added total of the format usage fee and a fax transmission fee may be collected as the charge fee in the case where the image of the user is set to the format and transmitted with a facsimile. In this case where the facsimile transmission operation is executed as the image forming operation, the charge fee is collected when the facsimile transmission operation is executed.

Figure 16:
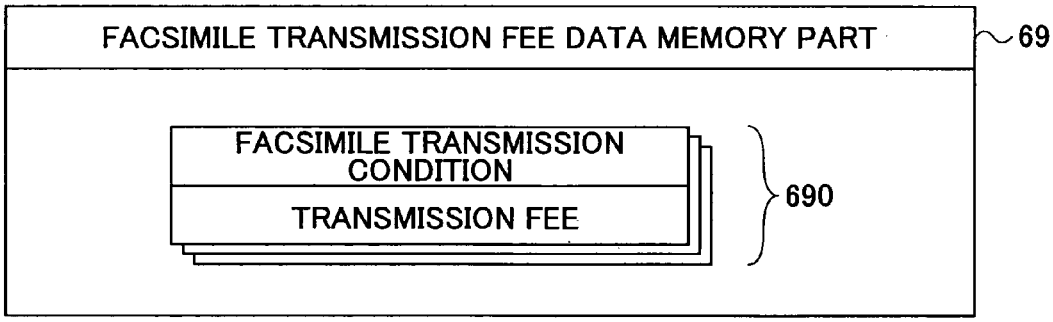
FIG. 16 is a diagram for describing data stored in a facsimile transmission fee data memory part according to an embodiment of the present invention.

For example, a facsimile transmission fee data memory part 69 is provided to the memory part 43 as shown in FIG. 16. The facsimile transmission fee data memory part 69 stores facsimile transmission data 690 in correspondence with respective facsimile transmission conditions. The facsimile transmission data 690 includes facsimile transmission conditions and transmission fees. The space including the facsimile transmission conditions stores data of facsimile transmission conditions, such as time periods for executing facsimile transmission. The space including the transmission fees stores data of transmission fees corresponding to the facsimile conditions. Furthermore, the management computer 41 extracts transmission fees in the facsimile transmission data based on the facsimile transmission conditions and the actual facsimile transmission conditions and calculates the charge fee based on the extracted transmission fees. Then, the calculated charge fee for the facsimile transmission is added to the format usage fee, to thereby obtain a total charge fee to be charged to the user.

Accordingly, the user is able to set the user's image to a desired format and transmit the image set to the format by facsimile. Accordingly, in a case of facsimile transmission, the fee for using the image forming apparatus 20 can be collected at the same location of the image forming apparatus 20 by collecting the charge fee with the coin dispenser 70.

In the above-described embodiments according to the present invention, the contents source data stored in the contents source data memory part 67 are made available for use. Alternatively, the use of each of the contents source data may be made available for a limited period. For example, a format can be provided in correspondence with a predetermined season; thereby making the format available only during the predetermined season.

In this case, the contents catalogue data 660 includes data of the available periods of the formats (contents source data). Here, the contents catalogue data 660 also serves as an available period data memory part (not shown). Accordingly, in a case where the present time falls in the available period, the management computer 41 extracts a corresponding contents catalogue data 660 in accordance with the present time and the data of the available period of the formats and displays a corresponding icon 92 on the format selection screen 90.

Accordingly, a format can be provided in accordance with the time (period) in which the printing operation is executed. Furthermore, the user is able to easily select a format in accordance with a predetermined period since the formats are provided in correspondence with predetermined periods.

In the above-described embodiments according to the present invention, the user operates the control panel P for setting printing conditions by selecting, for example, format printing, formats, repetitive printing, and paper sizes. In executing the format printing operation again, the conditions for executing the format printing operation may be automatically set; thereby the user need not to perform the selection procedure in a case of executing the same format printing operation.

For example, after once executing the format printing operation, a code is applied to the settings of the format printing operation. This code is provided to the user. For example, a paper indicated with a code (e.g. bar codes) may be printed out. In another example, the code may be recorded as electronic data to a recording medium. Then, in a case where the user executes the format printing operation with the same conditions, the code indicated on the paper (e.g. bar code) is read by the image reading apparatus 22. In the other example, the recording medium having the electronic data recorded thereto is inserted in the outside media input/output apparatus 23 and has its electronic data read out by the outside media input/output apparatus 23. Then, in accordance with the read out data, the image forming apparatus 20 is set with the same printing conditions. The image forming apparatus 20 allows the display apparatus 50 to display the photograph selection screen 110 in accordance with the read out code data. Accordingly, the user can immediately obtained printed material without having to set the conditions. This also prevents unfavorable printing results due to inadvertent setting of the conditions.

In the above-described embodiments of the present invention, multiple sheets of paper with a single printing request in a case of printing with a single format. Alternatively, the printing operation may be executed with multiple formats in correspondence with a single printing request.

For example, in a case of printing a 12 page calendar, formats indicative of, for example, dates corresponding to each month may be prepared and provided in the contents catalogue data 660. In a case where an icon 92 corresponding to the 12 page calendar is depressed, the content catalogue data 660 corresponding to the 12 page calendar and the contents source data are extracted.

In this embodiment of the present invention, the determination of change (Step S2-5 in the process of determining change) is executed by referring to each corresponding month in the contents catalogue data 660 in a case where the printing operation is interrupted. Furthermore, in a case where a fault occurs in a charging process (Step S5-5), the corresponding contents catalogue data 660 of the printed months is identified by referring to the amount of printed copies, and the charge fee corresponding to the actual printed copies are calculated according to the format usage fee and the print fee of the identified contents catalogue data 660.

Accordingly, the printing operation can be performed on multiple formats with a single print request. In this case also, shortage of change in the middle of the printing operation can be prevented from occurring. Furthermore, the charge fee corresponding to the amount of printed copies can be charged even in a case where the printing operation is interrupted.

In the above-described embodiments according to the present invention, the image data that is set to the format is image data recorded in a recording medium prepared by the user. Alternatively, the image data may be stored inside the image forming apparatus 20. Furthermore, the image data may be stored in a server connected to the image forming apparatus 20 via a network (e.g. Internet). The image data may be image data transmitted beforehand to the image forming apparatus 20 or the server by the user and extracted therefrom in the image forming operation.

In the above-described embodiments according to the present invention, the print fee of each type of paper is set in correspondence with each format. Alternatively, the print fee of each type of paper may be set independently from each format. For example, separate from the content catalogue data 660, data of the print fee may be set in correspondence with the type or size of paper. Accordingly, a charge fee based on the data of print fee and a charge fee based on the contents catalogue data 660 are added, to thereby obtain a total charge fee. Accordingly, the charge fee of the format usage and the charge fee of the printing operation are obtained with this simple setting of the charge fee.

In the above-described embodiments according to the present invention, the format is described mainly without having images and letters set thereto. However, the format may have images and letters set thereto. Accordingly, formats for various purposes may be prepared. Thereby, the user is able to be set (apply) its image to various printing formats.

The above-described embodiments according to the present invention mainly describe a case where an image prepared by the user is applied to a format. Alternatively, text data of the user may also be set to the format. In this case, a format having predetermined spaces for setting the image data and text data is used. Accordingly, the text data is set to this format. The input of the text data may be executed with the control panel P. Furthermore, the text data may be obtained from a server or a recording medium prepared by the user. Furthermore, the text data may be obtained from text data stored in the image forming apparatus 20. The manner in which the text data is displayed (e.g. size, style, color, etc.) may be set beforehand by the user, for example. Accordingly, text data prepared by the user can be set and printed with a desired format.

In the above-described embodiments according to the present invention, the information processing unit part B is provided inside the image forming apparatus 20. Alternatively, an information processing apparatus having the functions of the information processing unit part B may be provided separately with the image forming apparatus 20.

Further, the present invention is not limited to these embodiments, but variations and modifications may be made without departing from the scope of the present invention.

The present application is based on Japanese priority application No. 2004-079151 filed on Mar. 18, 2004 with the Japanese Patent Office, the entire contents of which are hereby incorporated by reference.

What is claimed is:

1. A charge method for charging a usage fee including a print fee and a format fee of an image forming apparatus, the charge method comprising the steps of:

a) storing format data and format fee data corresponding to the format data in a contents catalog;

b) storing print data and print fee data corresponding to the print data in the contents catalog;

c) reading one or more data items selected by a user;

d) extracting a format data item selected by the user from the format data;

e) processing the one or more data items by applying the one or more data items to the extracted format data item;

f) extracting a print data item selected by the user from the print data; and g) calculating the usage fee by adding the format fee data corresponding to the extracted format data item with the print fee data corresponding to the extracted print data item.

2. A charge apparatus for charging a usage fee including a printing fee and a format fee of an image forming apparatus, the charge apparatus comprising:

a first storing part for storing format data and format fee data corresponding to the format data in a contents catalog;

a second storing part for storing print data and print fee data corresponding to the print data in the contents catalog;

a reading part for reading one or more data items selected by a user;

a first extracting part for extracting a format data item selected by the user from the format data;

a processing part for processing the one or more data items by applying the one or more data items to the extracted format data item;

a second extracting part for extracting a print data item selected by the user from the print data; and a calculating part for calculating the usage fee by adding the format fee data corresponding to the extracted format data item with the print fee data corresponding to the extracted print data item.

3. A charge program for enabling a computer to execute a charge method, the program comprising the functions of:

a) storing format data and format fee data corresponding to the format data in a contents catalog;

b) storing print data and print fee data corresponding to the print data in the contents catalog;

c) reading one or more data items selected by a user;

d) extracting a format data item selected by the user from the format data;

e) processing the one or more data items by applying the one or more data items to the extracted format data item;

f) extracting a print data item selected by the user from the print data; and g) calculating the usage fee by adding the format fee data corresponding to the extracted format data item with the print fee data corresponding to the extracted print data item.

4. The charge method as claimed in claim 1, further comprising a step of erasing the one or more data items by overwriting random data over the one or more data items.

5. The charge method as claimed in claim 1, further comprising a step of:

displaying a plurality of icons corresponding to the formats on a format listing display.

6. The charge method as claimed in claim 1, further comprising a step of:

preventing cancellation of a printing operation due to shortage of change based on the calculated usage fee.

7. The charge method as claimed in claim 1, further comprising a step of re-calculating the usage fee when a fault occurs during a printing operation.

8. The charge apparatus as claimed in claim 2, further comprising:

an erasing part for erasing the one or more data items by overwriting random data over the one or more data items.

9. The charge apparatus as claimed in claim 2, further comprising:

a displaying part for displaying a plurality of icons corresponding to the formats on a format listing display.

10. The charge apparatus as claimed in claim 2, further comprising:

a preventing part for preventing cancellation of a printing operation due to shortage of change based on the calculated usage fee.

11. The charge apparatus as claimed in claim 2, wherein the calculating part recalculates the usage fee when a fault occurs during a printing operation.

12. The charge program as claimed in claim 3, further comprising a function of erasing the one or more data items by overwriting random data over the one or more data items.

13. The charge program as claimed in claim 3, further comprising a function of:

displaying a plurality of icons corresponding to the formats on a format listing display.

14. The charge program as claimed in claim 3, further comprising a function of:

preventing cancellation of a printing operation due to shortage of change based on the calculated usage fee.

15. The charge program as claimed in claim 3, further comprising a function of re-calculating the usage fee when a fault occurs during a printing operation.

* * * * *